US008734173B2

(12) United States Patent
Suzuki et al.

(10) Patent No.: US 8,734,173 B2
(45) Date of Patent: May 27, 2014

(54) CONNECTOR

(75) Inventors: Sachio Suzuki, Hitachi (JP); Hideaki Takehara, Hitachi (JP); Kunihiro Fukuda, Tsukuba (JP); Yuta Kataoka, Hitachi (JP); Jun Umetsu, Hitachi (JP); Shinya Hayashi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 149 days.

(21) Appl. No.: 13/416,452

(22) Filed: Mar. 9, 2012

(65) Prior Publication Data

US 2012/0244755 A1 Sep. 27, 2012

(30) Foreign Application Priority Data

Mar. 24, 2011 (JP) ..... 2011-066453

(51) Int. Cl.
*H01R 13/15* (2006.01)
*H01R 13/193* (2006.01)

(52) U.S. Cl.
CPC ..... *H01R 13/193* (2013.01)
USPC ..... 439/262

(58) Field of Classification Search
CPC ..... H01R 13/193
USPC ..... 439/262, 284, 259
See application file for complete search history.

(56) References Cited

U.S. PATENT DOCUMENTS 1,917,009 A * 7/1933 Betts et al. ..... 439/262
2,932,810 A * 4/1960 Novak ..... 439/61
2,961,629 A * 11/1960 Kamm ..... 439/61
3,016,509 A * 1/1962 Wanninger ..... 439/292
3,264,601 A * 8/1966 Hartholz ..... 439/701
3,601,759 A * 8/1971 Barker ..... 439/262
3,638,164 A * 1/1972 Glance et al. ..... 439/284
3,670,291 A * 6/1972 Garcia ..... 439/262
3,941,446 A * 3/1976 Cantwell ..... 439/262
4,392,705 A * 7/1983 Andrews et al. ..... 439/342
4,544,222 A * 10/1985 Andersson ..... 439/368

(Continued)

FOREIGN PATENT DOCUMENTS

JP 2004-056924 2/2004
JP 2009-070754 4/2009
JP 2010-244935 10/2010
JP 2011-014498 1/2011

OTHER PUBLICATIONS

Japanese Office Action dated Jan. 28, 2014 and English translation of notification of reasons for refusal.

*Primary Examiner* — Neil Abrams
(74) *Attorney, Agent, or Firm* — Roberts Mlotkowski Safran & Cole P.C.

(57) ABSTRACT

A connector includes a first terminal housing for housing a plurality of first connecting terminals aligned, a second terminal housing for housing a plurality of second connecting terminals aligned, a plurality of insulating members aligned and housed in the second terminal housing, a resin molded body provided in the second terminal housing, and an insulating member assembly formed by assembling the plurality of insulating members. The resin molded body includes at least one pair of restricting protrusions in order to restrict expanding movement of the insulating member assembly in the lamination direction when inserting the first connecting terminals into a gap between the second connecting terminals and the insulating members. The insulating member assembly includes a terminal protecting member to interfere with a rim of the first terminal housing to prevent the first terminal housing from being erroneously inserted into the gap.

3 Claims, 12 Drawing Sheets

(56) References Cited

U.S. PATENT DOCUMENTS

| | | | | | |
|---|---|---|---|---|---|
| 4,753,613 | A * | 6/1988 | Morgan | 439/701 |
| 4,842,539 | A * | 6/1989 | Fort et al. | 439/262 |
| 4,850,889 | A * | 7/1989 | LaSota | 439/262 |
| 4,971,575 | A * | 11/1990 | Martellotti | 439/496 |
| 5,083,939 | A * | 1/1992 | Ittah | 439/496 |
| 5,219,294 | A * | 6/1993 | Marsh et al. | 439/79 |
| 5,499,927 | A * | 3/1996 | Ohno et al. | 439/285 |
| 5,655,923 | A * | 8/1997 | Thompson | 439/291 |
| 5,692,921 | A * | 12/1997 | Jennings | 439/346 |
| 5,741,148 | A * | 4/1998 | Biernath | 439/284 |
| 5,760,339 | A * | 6/1998 | Faulkner et al. | 174/88 B |
| 6,068,518 | A * | 5/2000 | McEuen | 439/660 |
| 6,551,113 | B1 * | 4/2003 | Nishiyama et al. | 439/67 |
| 6,688,897 | B2 * | 2/2004 | Korsunsky et al. | 439/108 |
| 6,699,395 | B1 * | 3/2004 | Svenkeson et al. | 216/13 |
| 7,686,618 | B2 * | 3/2010 | Mizukami et al. | 439/61 |
| 7,794,247 | B2 | 9/2010 | Suzuki | |
| 7,837,514 | B2 * | 11/2010 | Fogg | 439/701 |
| 7,955,110 | B1 * | 6/2011 | Kataoka et al. | 439/284 |
| 8,123,546 | B2 * | 2/2012 | Suzuki et al. | 439/372 |
| 8,123,573 | B2 * | 2/2012 | Takehara et al. | 439/845 |
| 8,182,278 | B2 * | 5/2012 | Kataoka et al. | 439/266 |
| 8,192,230 | B2 * | 6/2012 | Kataoka et al. | 439/604 |
| 8,226,429 | B2 * | 7/2012 | Umetsu et al. | 439/262 |
| 8,272,891 | B2 * | 9/2012 | Kataoka et al. | 439/540.1 |
| 8,277,259 | B2 * | 10/2012 | Hattori et al. | 439/660 |
| 8,500,474 | B2 * | 8/2013 | Zimmermann et al. | 439/260 |
| 8,500,475 | B2 * | 8/2013 | Takehara et al. | 439/262 |
| 8,506,313 | B2 * | 8/2013 | Fukuda et al. | 439/262 |
| 8,517,753 | B2 * | 8/2013 | Kataoka et al. | 439/261 |
| 8,523,587 | B2 * | 9/2013 | Suzuki et al. | 439/262 |
| 8,608,498 | B2 * | 12/2013 | Suzuki et al. | 439/262 |
| 8,684,759 | B2 * | 4/2014 | Adachi et al. | 439/262 |
| 2009/0075506 | A1 | 3/2009 | Suzuki | |
| 2012/0244755 | A1 * | 9/2012 | Suzuki et al. | 439/660 |
| 2013/0196545 | A1 * | 8/2013 | Adachi et al. | 439/626 |

* cited by examiner

CONNECTOR

The present application is based on Japanese patent application No. 2011-066453 filed on Mar. 24, 2011, the entire contents of which are incorporated herein by reference.

BACKGROUND OF THE INVENTION

1. Field of the Invention

The invention relates to a connector which is used for, e.g., an eco-friendly car such as a hybrid car and an electric car, in particular, to a connector which may be potentially employed for a power harness used for transmitting a large amount of power.

2. Description of the Related Art

A power harness is used for connecting between devices such as between a motor and an inverter or between an inverter and a battery in, e.g., a hybrid car or an electric car, which has made significant progress in recent years, for transmitting a large amount of power, and a connector in a two-divided structure composed of, e.g., a male connector portion provided with a male terminal as well as a first terminal housing for housing the male terminal and a female connector portion provided with a female terminal connected to the male terminal as well as a second terminal housing for housing the female terminal is provided to one end of the power harness (see, e.g., JP-A-2009-070754). This connector is configured so that a front end portion of the first terminal housing of the male connector portion is housed in the second terminal housing of the second connector portion when the two connector portions are fitted to each other. Hereinafter, male and female (male side and female side) as a connector indicate a condition when fitting a terminal housing.

In recent years, all components in such an eco-friendly car have been lightened in weight in order to improve energy saving performance, and size reduction is desired as one of effective means of reducing weight.

A technique of Japanese patent No. 4037199 is an example of a known technique.

The technique described in Japanese patent No. 4037199 is an electric connection structure for vehicle in which connecting terminals of plural phases of conductive member led out from a vehicle driving motor are connected to connecting terminals of plural phases of power line cable led out from an inverter for driving the motor, a connecting terminal of each phase of the conductive member overlaps a corresponding connecting terminal of each phase of the power line cable, an insulating member is arranged on a surface opposite to an overlapping surface of the connecting terminals, and the overlapped connecting terminals of each phase are tightened and fixed to the insulating members in an overlapping direction by a single bolt provided at a position to penetrate therethrough.

In other words, the technique of Japanese patent No. 4037199 is a connection structure in which plural connecting terminals and insulating members compose a laminated structure and the connecting terminals are fixed and electrically connected all together at contact points by tightening a single bolt in an overlapping direction (or a lamination direction) while plural contact points as overlapping surfaces between the connecting terminals are sandwiched, and this kind of configuration is more effective in easy downsizing than the technique of JP-A-2009-070754.

SUMMARY OF THE INVENTION

However, the technique such as described in Japanese patent No. 4037199 has the following problems.

(1) The number of components is increased since a retaining jig for holding one end of each insulating member is a separate member.

(2) Since the retaining jig for holding one end of each insulating member is a separate member, a connection portion between the retaining jig and the insulating member consequently becomes large, and accordingly, the entire connection structure becomes large.

Thus, the inventors note that, when applying the laminated-type connection structure as in Japanese patent No. 4037199 to the connector, the connection structure needs to be further downsized. As the result of great efforts, a construction was devised in which an insulating member is fixed to one surface at the front end of the connecting terminals so as to omit the retaining jig.

However, the devised construction also has problems below.

For example, in case of a connecting terminal being fixed to a cable, there is a problem that the connecting terminal may move when an excessive force (e.g., a force to pull the cable or a force to push the cable into a connector) is applied to the cable, and a misalignment of the insulating members may be thereby caused. The similar problem occurs in a bus bar type connecting terminal (i.e., a terminal like a male terminal 4 described in JP-A-2009-070754) to which a cable is not fixed. For example, when the connector is dropped, an excess force may be applied to a tip of the bus bar type connecting terminal protruding from the connector, and the same problem as above may arise in this case.

Here, the misalignment of the insulating members includes a relative misalignment therebetween and a misalignment with respect to a terminal housing which houses the insulating members. It is needed to reduce both of the misalignments.

In case of attaching the insulating members to the male connector portion, it is possible to easily suppress the misalignment with respect to the terminal housing which houses the insulating members since the insulating members can be supported by the inner wall of the first terminal housing surrounding the outside thereof. However, in case of attaching the insulating members to the female connector portion, it is not easy to suppress the misalignment with respect to the terminal housing which houses the insulating members. This is because the first terminal housing of the male connector portion is to be inserted between the insulating members and the second terminal housing, so the insulating members cannot be supported by the inner wall of the second terminal housing surrounding the outside thereof.

The reason for attaching the insulating members to the female connector portion is as follows. For example, where a male connector portion is to be connected to a motor and a female connector portion is to be connected to an inverter, the male connector is fitted to the female connector to connect the motor and the inverter. In this case, no problem arises when a foreign object such as a finger contacts with the terminal of the male connector. By contrast, when a voltage is applied to the female connector portion, it is necessary to avoid contacting a foreign object such as a finger with the terminal of the female connector. Thus, the insulating members are desirably attached to the female connector portion not the male connector portion so as to prevent the foreign object such as a finger from contacting with the terminal. Meanwhile, though a contact preventing means may be additionally attached to the female connector portion, this is not desirable since the number of components increases.

On the other hand, in the laminated structure type connector, when inserting the male first terminal housing inside the female second terminal housing, the male first terminal housing may be erroneously obliquely inserted into the female second terminal housing since the opening of the housing is expanded in the lamination direction of the terminals. Thereby, the first terminal housing may collide with and damage the female terminals of the second terminal housing. Especially fitting the connectors in a narrow space may cause the damage of the female terminal, so a countermeasure therefor is desired.

Accordingly, it is an object of the invention to provide a laminated structure type connector that can be downsized and can prevent the misalignment of insulating members and the damage of terminals inside a female connector even when the insulating members are attached to a female connector portion.

(1) According to one embodiment of the invention, a connector comprises:

a first terminal housing for housing a plurality of first connecting terminals aligned;

a second terminal housing for housing a plurality of second connecting terminals aligned;

a plurality of insulating members aligned and housed in the second terminal housing;

a laminated structure that a front end portion of the first terminal housing is housed in the second terminal housing, and one surface of the plurality of first connecting terminals faces one surface of the plurality of second connecting terminals to form pairs and to form a plurality of contact points sandwiched between the plurality of insulating members when the first terminal housing is fitted to the second terminal housing;

a connecting member for collectively fixing and electrically connecting the plurality of first connecting terminals and the plurality of second connecting terminals at each contact point by pressing the plurality of first connecting terminals and the plurality of second connecting terminals;

a resin molded body provided in the second terminal housing behind the plurality of insulating members in a fitting direction to hold the plurality of second connecting terminals; and an insulating member assembly formed by assembling the plurality of insulating members so as to restrict movement of each of the insulating members in the fitting direction and in a width direction perpendicular to a lamination direction of the laminated structure and to the fitting direction, wherein the resin molded body comprises at least one pair of restricting protrusions to sandwich the insulating member assembly in the lamination direction in order to restrict expanding movement of the insulating member assembly in the lamination direction when inserting the first connecting terminals into a gap between the second connecting terminals and the insulating members, and wherein the insulating member assembly comprises a terminal protecting member to interfere with a rim of the first terminal housing to prevent the first terminal housing from being erroneously inserted into the gap for receiving the first connecting terminals.

In the above embodiment (1) of the invention, the following modifications and changes can be made.

(i) The terminal protecting member is formed protruding from the insulating member assembly in the insertion direction of the first connecting terminals at both sides of the gap in the width direction for receiving the first connecting terminals.

(ii) The insulating members comprise a plurality of first insulating members each provided on another surface of the plurality of second connecting terminals, and a second insulating member arranged to face another surface of the first connecting terminal that is located outermost when the plurality of first connecting members are alternately stacked on the plurality of second connecting terminals, wherein the first insulating members each comprise a connecting piece that extends from both ends of the first insulating members in a width direction thereof toward adjacent one of first and second insulating members, wherein the first insulating members or the second insulating member comprise a connecting groove receiving the connecting piece to be slidable in the lamination direction, formed on both side surfaces thereof, and wherein the terminal protecting member protrudes forward in the fitting direction from the connecting piece.

Points of the Invention

According to one embodiment of the invention, a connector is constructed such that plural insulating members are housed in the second terminal housing at the female connector side, the plural insulating members are assembled into an insulating member assembly to restrict the movement of the insulating members in the fitting direction and in the width direction, and a resin molded body has a restricting protrusion to sandwich the insulating member assembly in the lamination direction of the insulating members so as to restrict the expanding movement of the insulating member assembly in the lamination direction when inserting the first connecting terminals into between the second connecting terminals and the insulating members. Thereby, it is possible to prevent the relative misalignment of the insulating members even when a force is externally applied to pull or push cables connected to the second connecting terminals.

BRIEF DESCRIPTION OF THE DRAWINGS

Next, the invention will be explained in more detail in conjunction with appended drawings, wherein:

FIGS. 13A and 13B illustrate an assembly procedure of the second connector portion in FIG. 4A, wherein FIG. 13A is a perspective view showing a state in which a resin molded body is fixed to the second terminal housing and the packing is housed in a housing portion of the resin molded body and FIG. 13B is a perspective view including a cross section of parts in FIG. 13A;

FIGS. 15A and 15B illustrate the assembly procedure of the second connector portion in FIG. 4A, wherein FIG. 15A is a perspective view showing a state in which a cylindrical shield body is attached to the second terminal housing and FIG. 15B is a perspective view including a cross section of parts in FIG. 15A.

DETAILED DESCRIPTION OF THE PREFERRED EMBODIMENTS

An embodiment of the invention will be described below in conjunction with the appended drawings.

Figure 1A:
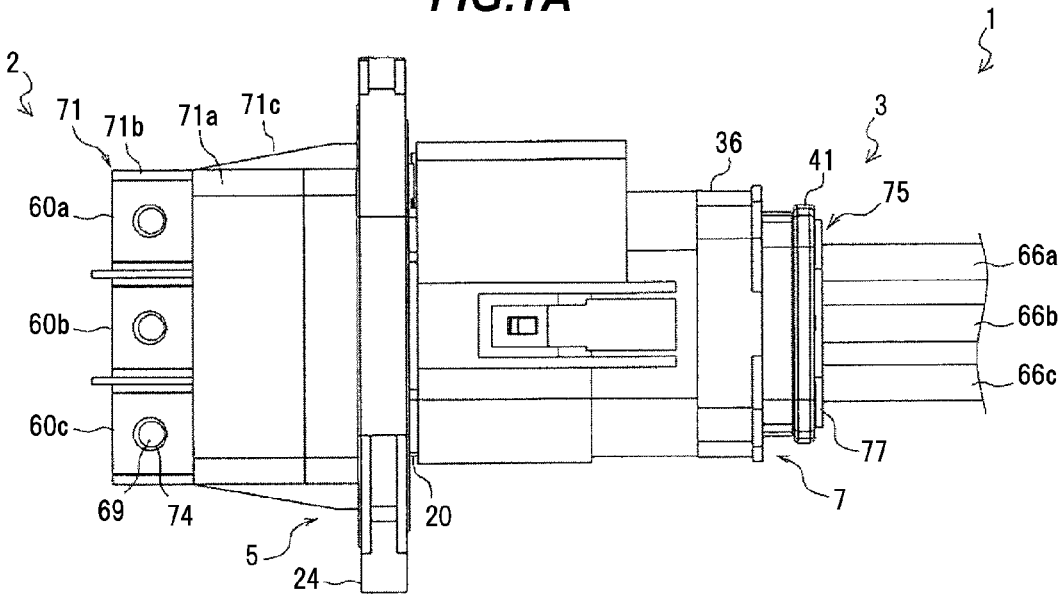
FIG. 1A is a plan view showing a connector in an embodiment of the invention.
Figure 1B:
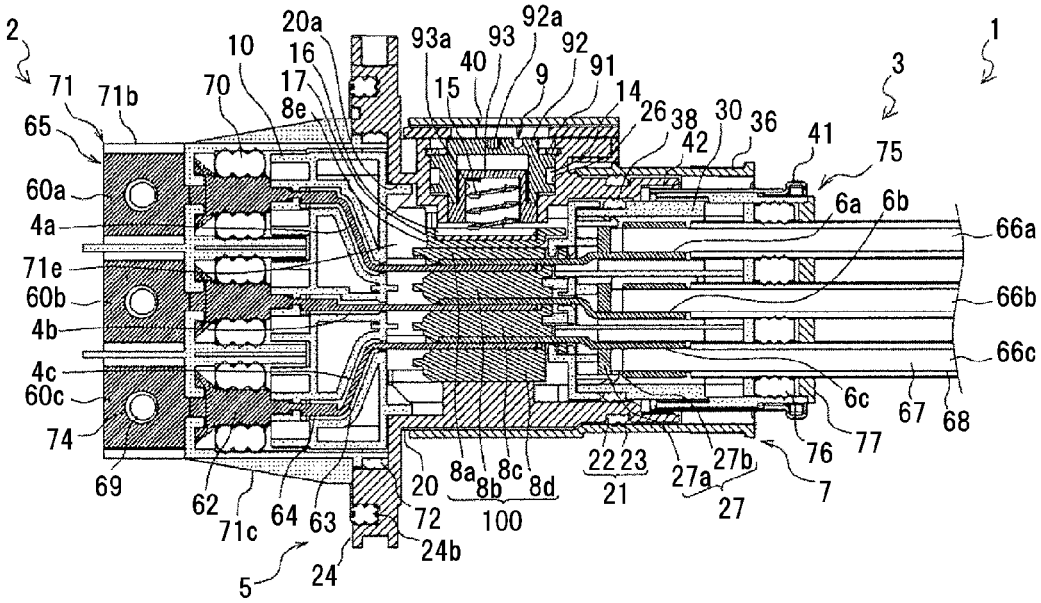
FIG. 1B is a cross sectional view of the connector in FIG. 1A.

FIG. 1A is a plan view showing a connector in the embodiment and FIG. 1B is a cross sectional view thereof.

As shown in FIGS. 1A and 1B, a connector 1 in the embodiment is composed of a first connector portion 2 and a second connector portion 3, and plural power lines are connected together by fitting the connector portions 2 and 3.

More specifically, the connector 1 is provided with the first connector portion 2 having a first terminal housing 5 housing plural (three) aligned first connecting terminals 4*a* to 4*c*, the second connector portion 3 having a second terminal housing 7 housing plural (three) aligned second connecting terminals 6*a* to 6*c*, and plural (four) insulating members 8*a* to 8*d* aligned and housed in the second terminal housing 7 for insulating the second connecting terminals 6*a* to 6*c* from each other, and the connector 1 is configured that, in the first terminal housing 5 of the first connector portion 2 and the second terminal housing 7 of the second connector portion 3 which are fitted to each other, the first connecting terminals 4*a* to 4*c* and the second connecting terminals 6*a* to 6*c* are alternately arranged to form a laminated structure in which surfaces of the plural first connecting terminals 4*a* to 4*c* on one side face surfaces of the plural second connecting terminals 6*a* to 6*c* on one side to form respective pairs (a pair of the first connecting terminal 4*a* and the second connecting terminal 6*a*, that of the first connecting terminal 4*b* and the second connecting terminal 6*b*, and that of the first connecting terminal 4*c* and the second connecting terminal 6*c*) and to form plural contact points, and each contact point is sandwiched by the insulating members 8*a* to 8*d*.

Hereinafter, a direction of laminating the first connecting terminals 4*a* to 4*c*, the second connecting terminals 6*a* to 6*c* and the insulating members 8*a* to 8*d* (a vertical direction in FIG. 1B) is referred to as a lamination direction, a direction of fitting the two terminal housings 5 and 7 (a horizontal direction in FIG. 1B) is referred to as a fitting direction, and a direction perpendicular to both the lamination direction and the fitting direction (a direction toward a paper plane in FIG. 1B) is referred to as a width direction.

The connector 1 is configured such that a front end portion (a portion on the right in FIG. 1B) of the first terminal housing 5 is inserted into the second terminal housing when the first terminal housing 5 of the first connector portion 2 is fitted to the second terminal housing 7 of the second connector portion 3. In other words, the connector 1 has the first connector portion 2 as a male connector and the second connector portion 3 as a female connector.

The connector 1 is used for connecting, e.g., a motor for driving a vehicle to an inverter for driving the motor. The embodiment is configured such that the first connector portion 2 provided in a motor is connected to the second connector portion 3 provided on cables 66*a* to 66*c* extending from an inverter, thereby electrically connecting the motor to the inverter.

Each configuration of the connector portions 2 and 3 will be described in detail below.

First Connector Portion

Firstly, the first connector portion 2 will be described.

Figure 2:
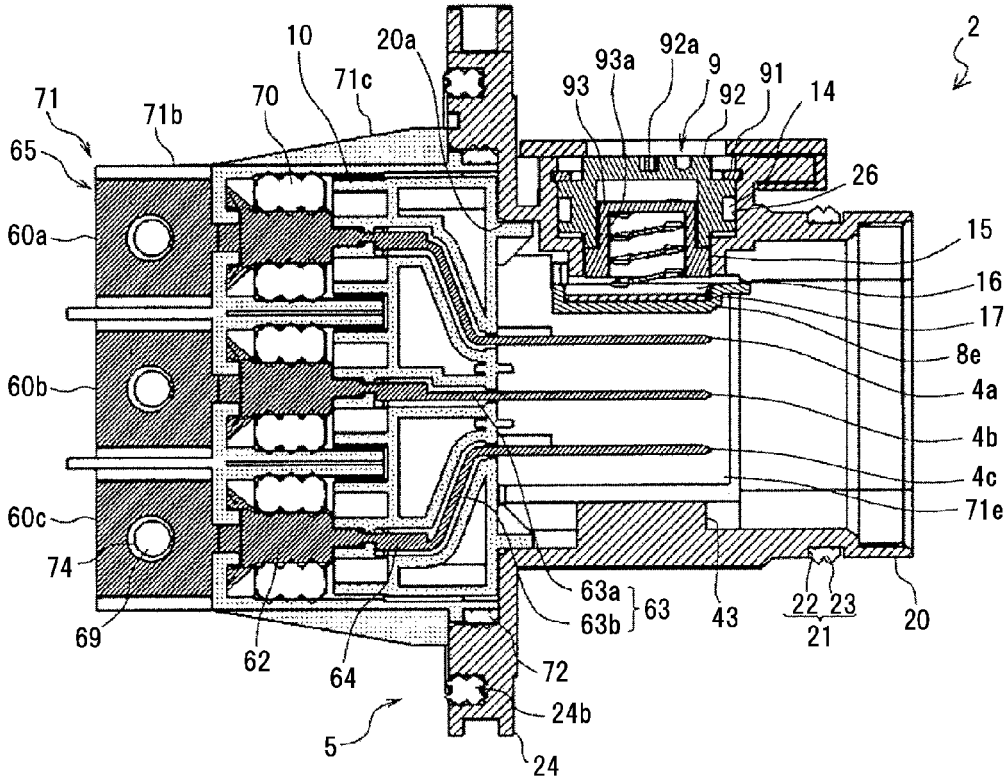
FIG. 2 is a cross sectional view showing a first connector portion of the connector in FIG. 1A.
Figure 3A:
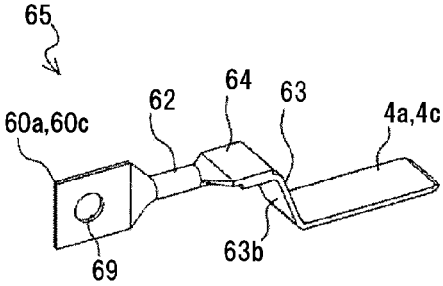
FIGS. 3A and 3B are perspective views showing a bus bar terminal of the connector in FIG. 1A.
Figure 3B:
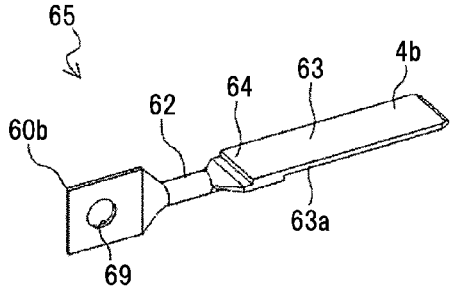

As shown in FIGS. 1A to 2, the first connector portion 2 holds, inside thereof, three first connecting terminals 4*a* to 4*c* aligned at predetermined intervals, and is provided with the first terminal housing 5 housing the three aligned first connecting terminals 4*a* to 4*c*, and a connecting member 9 for collectively fixing and electrically connecting the plural first connecting terminals 4*a* to 4*c* to the plural second connecting terminals 6*a* to 6*c* at respective contact points by pressing the adjacent insulating member 8*a*.

As shown in FIGS. 1A to 3B, the first connecting terminals 4*a* to 4*c* are formed as a plate-shaped terminal having a surface perpendicular to the lamination direction, and are respectively integrally provided, at proximal ends thereof, with device side connecting terminals 60*a* to 60*c* electrically connected to a device (a motor) to which the first terminal housing 5 is attached. The device side connecting terminals 60*a* to 60*c* are provided so that at least tip portions thereof protrude out of the first terminal housing 5. A hole 69 for passing a bolt to connect to a terminal as a connection target (a terminal of a cable, etc., in a motor) is each formed on the tip portions of the device side connecting terminals 60*a* to 60*c* at the center in the width direction.

The device side connecting terminals 60*a* to 60*c* are formed as a plate-shaped terminal having a surface parallel to both the lamination direction and the fitting direction (i.e., a surface perpendicular to the width direction). In other words, the surfaces of the plate-shaped terminals as the first connecting terminals 4*a* to 4*c* and the surfaces of the plate-shaped terminals as the device side connecting terminals 60*a* to 60*c* form an angle of 90° when viewed from the front side in the fitting direction. The device side connecting terminals 60*a* to 60*c* are held by a terminal block 71 provided on the first terminal housing 5 so as to be aligned in the lamination direction. The detailed structure of the terminal block 71 will be described later.

A plane orienting portion 62 for changing a surface orientation of the plate-shaped terminal is each formed between the first connecting terminals 4*a* to 4*c* and the device side connecting terminals 60*a* to 60*c*. At least a portion of the plane orienting portion 62 is formed in a circular shape in a horizontal cross sectional view, and a terminal sealing member 70 for ensuring air tightness between the terminal block 71 and the plane orienting portion 62 is provided around the circular-formed plane orienting portion 62. In other words, the plane orienting portion 62 has two functions, one of which is a plane orienting function for changing a surface orientation of the plate-shaped terminal and another of which is a sealing function for ensuring air tightness between the terminal block 71 and the plane orienting portion 62.

In order to ensure air tightness at, e.g., a rectangular (plate-shaped) portion in a horizontal cross sectional view, it is necessary to ensure air tightness by using a terminal sealing member 70 formed in a particular shape or made of a particular material or by applying a waterproof resin thereto. However, a structure as is in the embodiment in which the terminal sealing member 70 is provided around the plane orienting portion 62 formed in a circular shape in a horizontal cross sectional view allows use of a cheap rubber packing, etc., which is generally used as the terminal sealing member 70.

In the meantime, an arrangement pitch of the device side connecting terminals 60*a* to 60*c* in the lamination direction need to be large to some extent in order to facilitate connection to a terminal as a connection target (a terminal of a cable, etc., in a motor). On the other hand, it is desirably configured such that a laminated portion composed of the first connecting terminals 4*a* to 4*c* and the second connecting terminals 6*a* to 6*c* be as small as possible, i.e., an arrangement pitch of the first connecting terminals 4*a* to 4*c* in the lamination direction be as small as possible in order to downsize the connector 1. Therefore, in the connector 1, an arrangement pitch of the plural device side connecting terminals 60*a* to 60*c* in the lamination direction is larger than that of the first connecting terminals 4*a* to 4*c*, and a pitch changing portion 63 for changing an arrangement pitch in the lamination direction is formed between the first connecting terminals 4*a* to 4*c* and the device side connecting terminals 60*a* to 60*c*. In the embodiment, the pitch changing portion 63 is formed between the plane orienting portion 62 and the first connecting terminals 4*a* to 4*c*.

A pitch changing portion 63*a* formed between the first connecting terminal 4*b* and the device side connecting terminal 60*b* which are arranged in the middle of the lamination direction is formed in a plate shape which continuously linearly extends from the first connecting terminal 4*b* toward the proximal end. On the other hand, a pitch changing portion 63*b* formed between the first connecting terminals 4*a*, 4*c* and the device side connecting terminals 60*a*, 60*c* which are arranged on both sides in the lamination direction is formed in a plate shape continued to the first connecting terminals 4*a* and 4*c* in the similar manner to the pitch changing portion 63*a*, but is bent outward in the lamination direction at a position anterior to the plane orienting portion 62 so that the arrangement pitch is changed by the bending. That is, in the connector 1, the pitch changing portion 63*b* is bent so as to get gradually close to the first connecting terminal 4*b* located in the middle of the lamination direction, from the device side connecting terminals 60*a*, 60*c* toward the first connecting terminals 4*a*, 4*c*. The two pitch changing portions 63*b* on upper and lower sides are symmetrical.

The device side connecting terminals 60*a* to 60*c*, the plane orienting portion 62, the pitch changing portion 63 and the first connecting terminals 4*a* to 4*c* may be formed integrally, or may be formed as separate parts and joined afterward by welding, etc. The latter is employed in the embodiment, in which the device side connecting terminals 60*a* to 60*c* integrally formed with the plane orienting portion 62 and the pitch changing portion 63 integrally formed with the first connecting terminals 4*a* to 4*c* are integrally joined at a junction 64. Hereinafter, the integrated component composed of the device side connecting terminals 60*a* to 60*c*, the plane orienting portion 62, the pitch changing portion 63 and the first connecting terminals 4*a* to 4*c* is referred to as a bus bar terminal 65. It should be noted that the junction 64 is not formed in the former case, i.e., in the case where the device side connecting terminals 60*a* to 60*c*, the plane orienting portion 62, the pitch changing portion 63 and the first connecting terminals 4*a* to 4*c* are formed integrally.

In the method of manufacturing the bus bar terminal 65, firstly, both edges of a round bar as the plane orienting portion 62 are compressively-molded so that flat surfaces are orthogonal to each other, and one of the flat surfaces formed by the compression molding is determined as the device side connecting terminals 60*a* to 60*c* and another flat surface is determined as the first connecting terminals 4*a* to 4*c*. As described above, the length of the first connecting terminals 4*a* to 4*c* is extended by having the junction 64 in the embodiment.

Since the embodiment assumes the use of a three-phase AC power line between a motor and an inverter, alternate current having a phase difference of 120° is transmitted to each bus bar terminal 65. Each bus bar terminal 65 should be formed of a highly conductive metal such as silver, copper or aluminum to reduce transmission loss, etc., in the connector 1. In addition, each of the first connecting terminals 4*a* to 4*c* constituting the bus bar terminal 65 has little flexibility.

The bus bar terminals 65 are aligned and held at predetermined intervals by a resin molded body (first inner housing) 10 as a portion of the first terminal housing 5. The resin molded body 10 is formed of an insulating resin (e.g., PPS (polyphenylene sulfide) resin, PPA (polyphthalamide) resin, PA (polyamide) resin, PBT (polybutylene terephthalate) and epoxy-based resin) to prevent short circuit by insulating the bus bar terminals 65 from each other.

In the embodiment, a substantially rectangular parallelepiped resin molded body 10 is formed so as to cover the bus bar terminal 65 from an end of the plane orienting portion 62 on the pitch changing portion 63 side to the proximal end of the first connecting terminals 4*a* to 4*c*, and each bus bar terminal 65 is fixed to the resin molded body 10 by fitting each bus bar terminal 65 to a groove preliminary formed on the resin molded body 10. However, it is not limited thereto, and for example, each bus bar terminal 65 may be held by inserting at the time of molding the resin molded body 10 followed by the curing of the resin.

In addition, a level difference formed at the junction 64 of each bus bar terminal 65 is used in the embodiment such that misalignment of each bus bar terminal 65 in the fitting direction is suppressed by engaging the level difference of the junction 64 with the resin molded body 10. That is, the junction 64 also serves to suppress misalignment of each bus bar terminal 65 in the fitting direction with respect to the resin molded body 10.

In the embodiment, the connecting member 9 has a ring-shaped support 91 fixed to the first terminal housing 5, a rotating portion 92 of which upper portion is inserted into a hollow of the ring-shaped support 91 so as to be rotatably supported thereby, and a pressing portion 93 vertically moving with respect to the rotating portion 92 by turning the rotating portion 92 and pressing the insulating member 8*a* adjacent thereto.

An irregular-shaped hole (a star-shaped hole, here) 92*a* for fitting a tool such as a wrench is formed on the upper surface of the rotating portion 92 (on a surface opposite to the first insulating member 8*a*), and the connecting member 9 is configured such that the pressing portion 93 vertically moves with respect to the rotating portion 92 (in a lamination direction which is a vertical direction in FIG. 1B) by turning the rotating portion 92 and then presses the adjacent first insulating member 8*a*. The detailed structure of the connecting member 9 will be described later.

The connector 1 is configured such that the connecting member 9 is provided on the first connector portion 2 and the plural insulating members 8*a* to 8*d* are provided on the second connector portion 3, and in the embodiment, the insulating member 8*a* which is adjacent to the connecting member 9 when fitting the two connector portions 2 and 3 to each other is divided into two pieces in the lamination direction, and the one of the two divided insulation members which is located on the outer side in the lamination direction (the upper side in FIG. 1B) is integrally provided with the connecting member 9. In other words, the embodiment is configured such that a portion of the insulating member 8*a* adjacent to the connecting member 9 is divided and is integrally provided with the connecting member 9. The portion of the insulating member 8*a* integrally provided with the connecting member 9 is referred to as a third insulating member 8*e*.

In the present specification, only the divided insulation member located inward in the lamination direction after division (i.e., the divided insulation member provided on the second connector portion 3) is hereinafter referred to as the insulating member 8*a* in order to simplify the explanation. In other words, the connector 1 in the embodiment is configured such that, when the two connector portions 2 and 3 are fitted to each other, the third insulating member 8*e* and the insulating member 8*a* are integrated and form one insulating member, and the pressing portion 93 of the connecting member 9 presses the insulating member 8*a* adjacent thereto via the third insulating member 8*e*.

An elastic member 15 for imparting a predetermined pressing force to the third insulating member 8*e* is provided between the lower surface of the pressing portion 93 of the connecting member 9 and the upper surface of the third insulating member 8*e* immediately therebelow. In the embodiment, a concave portion 93*a* is formed on the lower surface of the pressing portion 93 to house the upper portion of the elastic member 15 therein. This is an idea to reduce a distance between the pressing portion 93 and the third insulating member 8*e* and to downsize the connector 1 even when the elastic member 15 is long to some extent. The elastic member 15 is composed of a spring formed of metal (e.g., SUS, etc.). The elastic member 15 is regarded as a portion of the connecting member 9 in the embodiment.

A concave portion 16 for covering (housing) a lower portion of the elastic member 15 is formed on the upper surface of the third insulating member 8*e* with which the lower portion of the elastic member 15 is in contact, and a receiving member 17 formed of metal (e.g., SUS, etc.) for preventing the third insulating member 8*e* formed of an insulating resin from being damaged by receiving the elastic member 15 is provided on a bottom of the concave portion 16 (i.e., a seat portion with which the lower portion of the elastic member 15 is in contact).

The receiving member 17 prevents damage to the third insulating member 8*e* by dispersing stress applied from the elastic member 15 to the upper surface of the third insulating member 8*e*. Therefore, a contact area between the receiving member 17 and the third insulating member 8*e* is preferably as large as possible. The receiving member 17 having a shape in contact throughout the entire bottom surface of the concave portion 16 is provided in the embodiment in order to increase the contact area between the receiving member 17 and the third insulating member 8*e*.

The first terminal housing 5 has a hollow cylindrical body 20 having a substantially rectangular shaped horizontal cross-section. An outer peripheral portion of one side (on the right side in FIG. 2) of the cylindrical body 20 which is fitted to the second terminal housing 7 is formed in a tapered shape in light of fitting properties to the second connector portion 3. Meanwhile, a terminal housing waterproof structure 21 for sealing between the first connector portion 2 and the second connector portion 3 is provided on the outer peripheral portion of the one side of the cylindrical body 20. The terminal housing waterproof structure 21 is composed of a concave portion 22 formed on the outer peripheral portion of the one side of the cylindrical body 20 and a packing 23 such as an O-ring provided on the concave portion 22.

An opening 20*a* which opens on one side of the cylindrical shape is formed inside the cylindrical body 20 on another side (on the left side in FIG. 2), i.e., opposite to the side to be fitted to the second terminal housing 7, and the first connecting terminals 4*a* to 4*c* of the bus bar terminal 65 are inserted through the opening 20*a*. The resin molded body 10 holding each bus bar terminal 65 is arranged so as to block the opening 20*a*.

A flange 24 for attaching the first connector portion 2 to a housing of a device, etc., (a shield case of a motor in the embodiment) is formed on the outer periphery of the other side of the cylindrical body 20. The flange 24 has a mounting hole 24*a* through which a non-illustrated bolt is inserted for fixation to the housing of the device, etc. Although the flange 24 provided on the first connector portion 2 is described in the embodiment, the flange 24 may be provided on the second connector portion 3 or on both the first connector portion 2 and the second connector portion 3. A packing 24*b* for ensuring air tightness between the housing of the device, etc., and the flange 24 is formed on the flange 24.

The flange 24 is effective to improve heat dissipation. That is, a surface area of the first terminal housing 5 can be increased by forming the flange 24, and it is thus possible to improve the heat dissipation when heat generated inside the first connector portion 2 (e.g., heat generated at each contact point) is released to the outside through the first terminal housing 5.

A connecting member insertion hole 26 for inserting the connecting member 9 therethrough is formed on the upper portion (on the upper side in FIG. 1B) of the cylindrical body 20. A portion of the first terminal housing 5 as a periphery of the connecting member insertion hole 26 is formed in a cylindrical shape (a hollow cylindrical shape). In addition, a sandwiching-holding base 43 is formed on the inner wall of the cylindrical body 20 at a position opposite to the connecting member insertion hole 26 (the lower side in FIG. 1B). The sandwiching-holding base 43 comes into contact with a surface of a below-described insulating member assembly 100 on an opposite side to the connecting member 9 when the two connector portions 2 and 3 are fitted to each other, and the insulating member assembly 100 is sandwiched and held between the connecting member 9 and the sandwiching-holding base 43 by the pressure from the connecting member 9.

For shielding performance, heat dissipation and weight saving of the connector 1, the cylindrical body 20 is preferably formed of light metal having high electrical and thermal conductivity such as aluminum, but may be formed of resin, etc. In the embodiment, the cylindrical body 20 is formed of aluminum.

In the connector 1 of the embodiment, a terminal block 71 for aligning and holding the device side connecting terminals 60*a* to 60*c* of each bus bar terminal 65 in the lamination direction is provided on the other side of the cylindrical body 20. The terminal block 71 is formed of an insulating resin to prevent short circuit by insulating the bus bar terminals 65 from each other.

The terminal block 71 has a substantially rectangular parallelepiped basal portion 71*a* which houses the resin molded body 10 and is attached to the cylindrical body 20, and a pedestal portion 71*b* integrally provided with the basal portion 71*a* on the opposite side to the cylindrical body 20 to align and hold the tip portions of the device side connecting terminals 60*a* to 60*c* of each bus bar terminal 65 in the lamination direction.

A packing 72 is provided on an outer periphery of an end portion of the basal portion 71*a* on the cylindrical body 20 side to ensure air tightness between the basal portion 71*a* of the terminal block 71 and the cylindrical body 20.

The basal portion 71*a* of the terminal block 71 is also inserted into the shield case of the motor when the first connector portion 2 is connected to the motor. Therefore, a tapered portion 71*c* of which width (width in the lamination direction) is gradually widened from the pedestal portion 71*b* toward the cylindrical body 20 is formed on both sides of the basal portion 71*a* in the lamination direction. The tapered portion 71*c* is inserted into a groove formed on the shield case of the motor to serve to guide the first connector portion 2 when connecting the first connector portion 2 to the motor.

Furthermore, a pair of wall portions 71*e* each extending in the cylindrical body 20 as well as between the first connecting terminals 4*a* to 4*c* and the cylindrical body 20 so as to sandwich the first connecting terminals 4*a* to 4*c* in a width direction is formed at a proximal end (an end portion opposite to the pedestal portion 71*b*) of the basal portion 71*a*. The wall portion 71*e* is formed so as to cover the most part of the side surfaces of the first connecting terminals 4*a* to 4*c* and is configured to increase a creepage distance from the first connecting terminals 4*a* to 4*c* to the cylindrical body 20.

The pedestal portion 71*b* is configured to contact with and hold surfaces of the tip portions of the device side connecting terminals 60*a* to 60*c*. A recessed groove (not shown) which opens on the opposite side to the basal portion 71*a* is formed on the pedestal portion 71*b* below each of the device side connecting terminals 60*a* to 60*c* and a nut 74 to be screwed together with a bolt used for connecting to a terminal as a connection target (a terminal of a cable, etc., in a motor) is inserted into the recessed groove. The nut 74 is arranged so that a screw hole thereof is aligned with the hole 69 of the device side connecting terminals 60*a* to 60*c*.

Second Connector Portion

Next, the second connector portion 3 will be described.

As shown in FIGS. 1A, 1B and 4A to 5B, the second connector portion 3 has the second terminal housing 7 housing plural (three) aligned second connecting terminals 6*a* to 6*c* and plural insulating members 8*a* to 8*d* in a substantially rectangular parallelepiped shape which are provided in the second terminal housing 7 for insulating the second connecting terminals 6*a* to 6*c* from each other.

The cables 66*a* to 66*c* extending from the inverter side are respectively connected to edges of the second connecting terminals 6*a* to 6*c* on one side. Electricity of different voltage and/or current corresponding to each bus bar terminal 65 is transmitted to the respective cables 66*a* to 66*c*. The cables 66*a* to 66*c* are each composed of a conductor 67 and an insulation layer 68 formed on the outer periphery thereof. The conductor 67 having a cross-sectional area of 20 $mm^2$ is used in the embodiment.

The cables 66*a* to 66*c* are each aligned and held at predetermined intervals by a resin molded body (second inner housing) 30 which is in a multi-cylindrical shape. The resin molded body 30 positions and holds the second connecting terminals 6*a* to 6*c* respectively on the first connecting terminals 4*a* to 4*c* (i.e., connection target) which face the second connecting terminals 6*a* to 6*c* to be respectively paired therewith when the first connector portion 2 is fitted to the second connector portion 3. The resin molded body 30 is provided in the second terminal housing 7 so as to locate posterior to the plural insulating members 8*a* to 8*d* in the fitting direction (on the right in the drawing).

The resin molded body 30 is formed of an insulating resin to prevent short circuit by insulating the second connecting terminals 6*a* to 6*c* from each other. The resin molded body 30 allows the second connecting terminals 6*a* to 6*c* to be held at respective predetermined positions even though each of the cables 66*a* to 66*c* respectively connected to the second connecting terminals 6*a* to 6*c* is very flexible.

Although the resin molded body 30 positions the second connecting terminals 6*a* to 6*c* by holding the cables 66*a* to 66*c*, it is not limited thereto. The resin molded body 30 may directly hold and position the second connecting terminals 6*a* to 6*c* while holding the cables 66*a* to 66*c*. Alternatively, a connecting terminal holding member for directly holding the second connecting terminals 6*a* to 6*c* without holding the cables 66*a* to 66*c* may be used.

In a case that the resin molded body 30 determines the positions of the second connecting terminals 6*a* to 6*c* by holding the cables 66*a* to 66*c* without directly holding the second connecting terminals 6*a* to 6*c*, i.e., in the case as is the embodiment, use of flexible cables 66*a* to 66*c* allows the tips of the second connecting terminals 6*a* to 6*c* to flexibly move with respect to the second terminal housing 7, and it is thereby possible to suppress deformation of the second connecting terminals 6*a* to 6*c* caused by pressure from the connecting member 9.

In addition, a non-illustrated braided shield is wound around portions of the cables 66*a* to 66*c* which are out of the second terminal housing 7, in order to improve the shielding performance. The braided shield is in contact with a below-described cylindrical shield body 41, and is electrically connected to the first terminal housing 5 via the cylindrical shield body 41 (the same potential (GND)).

The second connector portion 3 is provided with a slip-off preventing mechanism 27 so that the cables 66*a* to 66*c* are not pulled out from the resin molded body 30 even when the cables 66*a* to 66*c* are pulled. The slip-off preventing mechanism 27 is composed of a protrusion 27*a* each formed at the proximal ends of the second connecting terminals 6*a* to 6*c* (in the vicinity of the cables 66*a* to 66*c*) and a locking projection 27*b* which is provided in each cylinder of the multi-cylindrical resin molded body 30 in a protruding manner to restrict movement of the protrusion 27*a* in a direction to pull and push the cables 66*a* to 66*c* by locking with the protrusion 27*a*.

As shown in FIGS. 6A to 7B, each of the second connecting terminals 6*a* to 6*c* has a caulking portion 45 for caulking the conductor 67 which is exposed at a tip portion of the cables 66*a* to 66*c* and a plate-like contact point 46 integrally formed with the caulking portion 45.

A pitch changing portion 47 is formed on the plate-like contact point 46 of the second connecting terminals 6*a* to 6*c* to make the arrangement pitch of the cables 66*a* to 66*c* in the lamination direction larger than that of the second connecting terminals 6*a* to 6*c* in the lamination direction and to ensure a space for arranging a below-described packing 76.

The pitch changing portion 47 formed on the second connecting terminal 6*b* which is arranged in the middle of the lamination direction is bent at a trunk portion of the plate-like contact point 46 so that the front end portion of the second connecting terminal 6*b* is located at the center of the cable 66*b* (the center in the lamination direction). On the other hand, the pitch changing portion 47 formed on the second connecting terminals 6*a* and 6*c* which are arranged on both sides in the lamination direction is bent outward in the lamination direction between the front end portion of the second connecting terminals 6*a* and 6*c* and the caulking portion 45 so that the arrangement pitch is changed by the bending. That is, in the connector 1, the pitch changing portion 47 is bent so that the second connecting terminals 6*a* and 6*c* get gradually, from the caulking portion 45 side toward the front end side, close to the second connecting terminal 6*b* located in the middle of the lamination direction. The two pitch changing portions 47 on upper and lower sides are symmetrical. The protrusion 27*a* of the slip-off preventing mechanism 27 is formed to protrude upward (downward) from both widthwise end portions of the plate-like contact point 46 at the proximal end thereof (an end portion close to the caulking portion 45 side beyond the pitch changing portion 47).

Each of the second connecting terminals 6*a* to 6*c* should be formed of a highly conductive metal such as silver, copper or aluminum to reduce transmission loss, etc., in the connector 1. In addition, each of the second connecting terminals 6*a* to 6*c* has little flexibility.

Among the plural insulating members 8*a* to 8*d*, the plural first insulating members 8*a* to 8*c* are aligned and housed in the second terminal housing 7 and are also provided integrally with the respective surfaces of the plural second connecting terminals 6*a* to 6*c* on another side (surfaces opposite to the surfaces connected to the first connecting terminals 4*a* to 4*c*), and a second insulating member 8*d* is provided so as to face the surface of the outermost first connecting terminal 4*c* (the lowermost side in FIG. 1B) on another side (a surface opposite to the surface connected to the second connecting terminal 6*c*) when the plural first connecting terminals 4*a* to 4*c* and the plural second connecting terminals 6*a* to 6*c* form a laminated state.

The first insulating members 8*a* to 8*c* are provided on the second connecting terminals 6*a* to 6*c* at positions to protrude on the tip side. Each corner of the first insulating members 8*a* to 8*c* on a side to insert and extract the first connecting terminals 4*a* to 4*c* is chamfered. In addition, a corner of the second insulating member 8*d* on a side to insert and extract the first connecting terminals 4*a* to 4*c* and also on the first insulating member 8*c* side is also chamfered. Furthermore, a protruding portion (a build-up surface) for filling level difference from the second connecting terminals 6*a* to 6*c* is each formed on the surfaces of the first insulating members 8*a* to 8*c* on which the second connecting terminals 6*a* to 6*c* are provided so that the lower surfaces (lower side in the drawing) of the plural first insulating members 8*a* to 8*c* are respectively flush with the lower surfaces (lower side in the drawing) of the second connecting terminals 6*a* to 6*c*. Due to this configuration, the tip portions of the second connecting terminals 6*a* to 6*c* do not contact with the tip portions of the first connecting terminals 4*a* to 4*c* to be inserted when the first connector portion 2 is fitted to the second connector portion 3, hence, an effect of improving insertability of the first connecting terminals 4*a* to 4*c*.

In the connector 1 of the embodiment, the insulating member assembly 100 is formed by connecting the insulating members 8*a* to 8*d* each other so as to restrict movement of the insulating members 8*a* to 8*d* in the fitting direction as well as in the width direction.

As shown in FIGS. 4A to 5B and 8, the insulating member assembly 100 is formed by sequentially connecting each of the insulating members 8*a* to 8*d* in the lamination direction. That is, the insulating member assembly 100 is formed by respectively connecting the first insulating member 8*a* to the first insulating member 8*b*, the first insulating member 8*b* to the first insulating member 8*c*, and the first insulating member 8*c* to the second insulating member 8*d*.

A connecting piece 81 extending from both widthwise end portions of the first insulating members 8*a* to 8*c* toward the opposite insulating members 8*b* to 8*d* (toward the first insulating member 8*b* from the first insulating member 8*a*, the first insulating member 8*c* from the first insulating member 8*b* and the second insulating member 8*d* from the first insulating member 8*c*) with the second connecting terminals 6*a* to 6*c* interposed therebetween on which the first insulating members 8*a* to 8*c* are provided is each integrally formed on the first insulating members 8*a* to 8*c*. In addition, a connecting groove 82 for receiving the connecting piece 81 to be slidable in the lamination direction is each formed on the both side surfaces of the insulating members 8*b* to 8*d* opposite to the first insulating members 8*a* to 8*c* (facing with the second connecting terminals 6*a* to 6*c* interposed therebetween to which the first insulating members 8*a* to 8*c* are fixed).

The insulating members 8*a* to 8*d* are each connected to be relatively movable in the lamination direction by respectively receiving the connecting piece 81 of the first insulating member 8*a* in the connecting groove 82 of the first insulating member 8*b*, the connecting piece 81 of the first insulating member 8*b* in the connecting groove 82 of the first insulating member 8*c* and the connecting piece 81 of the first insulating member 8*c* in the connecting groove 82 of the second insulating member 8*d*, and the insulating member assembly 100 is thereby formed.

The connecting groove 82 is formed so that the width thereof in the fitting direction is substantially equal to that of the connecting piece 81 to be received. This restricts the movement of the insulating members 8*a* to 8*d* in the fitting direction. Furthermore, the connecting pieces 81 formed at the both widthwise end portions of the first insulating members 8*a* to 8*c* are received by the connecting grooves 82 formed on the both side surfaces of the opposite insulating members 8*b* to 8*d*, and thus, the opposite insulating members 8*b* to 8*d* are sandwiched by the connecting pieces 81 in the width direction, which restricts the widthwise movement of the insulating members 8*a* to 8*d*.

A squared U-shaped fitting groove 83 is formed at the proximal end of each connecting piece 81 and the first insulating members 8*a* to 8*c* are provided on the second connecting terminals 6*a* to 6*c* by fitting the second connecting terminals 6*a* to 6*c* to the fitting grooves 83. As a result, the first insulating members 8*a* to 8*c* are held by the second terminal housing 7 via the second connecting terminals 6*a* to 6*c*, the cables 66*a* to 66*c* and the resin molded body 30, and the positions of the first insulating members 8*a* to 8*c* with respect to the second terminal housing 7 are thereby determined.

In addition, a protrusion 84 protruding outward in a width direction from both sides of the second insulating member 8*d* for receiving the connecting piece 81 of the opposite first insulating member 8*c* is formed on the second insulating member 8*d*.

In the connector 1 of the embodiment, in order to restrict the expanding movement of the insulating member assembly 100 in the lamination direction at the time of inserting the first connecting terminals 4*a* to 4*c* into gaps between the second connecting terminals 6*a* to 6*c* and the insulating members 8*b* to 8*d*, at least a pair of restricting protrusions 85 each protruding forward in the fitting direction (toward left in FIG. 4A) is provided on the resin molded body 30 so as to sandwich the insulating member assembly 100 in the lamination direction.

In the embodiment, two pairs of restricting protrusions 85 having a substantially rectangular shape in a cross sectional view are provided so as to respectively sandwich both widthwise end portions of the insulating member assembly 100 in the lamination direction. The restricting protrusions 85 are provided so as to sandwich the connecting piece 81 and the protrusion 84 which are located at the both widthwise end portions of the insulating member assembly 100.

Furthermore, in the embodiment, an engaging groove 86 is each formed on the insulating members 8*a* and 8*d* which are located on the both sides of the insulating member assembly 100 in the lamination direction, and a pair of engaging claws 87 to be engaged with the respective engaging grooves 86 is formed on the resin molded body 30 so as to sandwich the insulating member assembly 100 in the lamination direction.

Here, a hole penetrating the insulating members 8*a* and 8*d* in the lamination direction is formed as the engaging groove 86, however, it is not necessary to penetrate. The engaging groove 86 is formed in a substantially rectangular shape in a top view and has substantially the same width as the engaging claw 87 so that the engaging claw 87 which is engaged does not wobble. Since the insulating members 8*a* to 8*d* composing the insulating member assembly 100 are movable in the lamination direction within a range sandwiched between the restricting protrusion 85 and the engaging claw 87 in the state that the two connector portions 2 and 3 are not fitted to each other, it is necessary to configure the engaging groove 86 and the engaging claw 87 so as not to release the engagement therebetween even when the insulating members 8*a* and 8*d* are moved in the lamination direction.

The insulating member assembly 100 is fixed to the resin molded body 30 by engaging the engaging claws 87 of the resin molded body 30 with the engaging grooves 86 on the insulating members 8*a* and 8*d*. This prevents the insulating member assembly 100 from falling to outside of a cylindrical body 36 even when the insulating member assembly 100 is pulled from the opening (the opening on the left in FIG. 4A) of the cylindrical body 36. In addition, since the both widthwise end portions of the insulating member assembly 100 are sandwiched by the restricting protrusions 85, the insulating member assembly 100 does not expand too much in the lamination direction when the two connector portions 2 and 3 are fitted to each other, and the position of the insulating member assembly 100 in the lamination direction with respect to the resin molded body 30 is restricted within a range sandwiched by the restricting protrusions 85.

In addition, by forming the insulating member assembly 100, it is possible to prevent the positions of the insulating members 8*a* to 8*d* from being misaligned even when a force (e.g., a force to pull the cables 66*a* to 66*c* or a force to push the cables 66*a* to 66*c* into the first connector portion 2) is applied to the cables 66*a* to 66*c*, and as a result, it is possible to prevent the first connecting terminals 4*a* to 4*c* from butting against the insulating members 8*a* to 8*d* at the time of connecting the two connector portions 2 and 3 and a fitting operation can be smoothly carried out.

Furthermore, in the embodiment, the insulating member assembly 100 is provided with a terminal protecting member 88 which comes into contact with a rim of the first terminal housing 5 to prevent the first terminal housing 5 from being inserted into the gaps for inserting the first connecting terminals 4*a* to 4*c* (gaps between the second connecting terminals 6*a* to 6*c* and the insulating members 8*a* to 8*d*).

The terminal protecting members 88 are provided on both sides of the gaps for inserting the first connecting terminal 4*a* to 4*c* in a protruding manner. In the embodiment, the terminal protecting member 88 is provided to protrude forward from the connecting piece 81. The terminal protecting member 88 is formed continuous to the connecting piece 81 and has a substantially rectangular shape in a cross sectional view. In addition, the terminal protecting member 88 is formed so as to extend to a proximal end of a chamfered portion at the front end portion of the insulating members 8*a* to 8*d*.

In addition, a protrusion 89 is each formed on the insulating members 8*a* to 8*d* so as to protrude forward in the fitting direction from a middle portion (middle in the lamination direction) of a front end face of the insulating members 8*a* to 8*d*. The protrusion 89 is formed to extend along a width direction wrapping around side faces of the insulating members 8*a* to 8*d* to the front end portion of the terminal protecting member 88. On the insulating member 8*d*, two protrusions 84 and 89 are continuously formed. The protrusion 89 serves to prevent short-circuit by increasing a creepage distance between adjacent contact points (or between a contact point and the first terminal housing 5). Likewise, the terminal protecting member 88 also serves to prevent short-circuit by covering side faces of each contact point and increasing a creepage distance between adjacent contact points. That is, the terminal protecting member 88 has two functions, one of which is a function of preventing the first terminal housing 5 from being inserted into the gaps between the second connecting terminals 6*a* to 6*c* and the insulating members 8*b* to 8*d* and another of which is a function of increasing a creepage distance between adjacent contact points.

Figure 9:
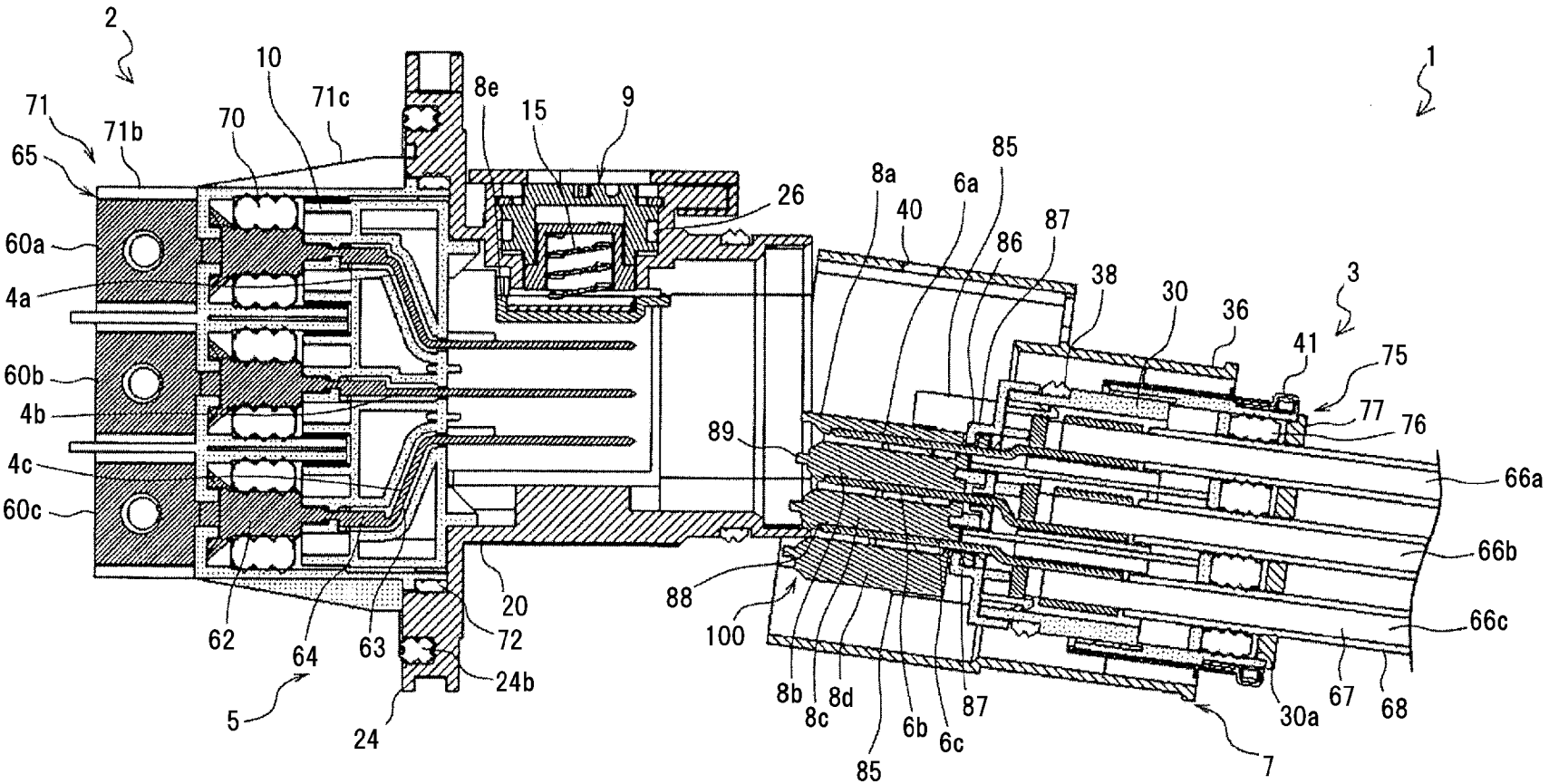
FIG. 9 illustrates that, in the connector in FIG. 1A, it is possible to prevent the insertion of the first terminal housing into a gap between the second terminal and an insulating member at the time of fitting.

Providing the terminal protecting member 88 prevents the first terminal housing 5 from being inserted into the gaps between the second connecting terminals 6*a* to 6*c* and the insulating members 8*b* to 8*d* since the terminal protecting member 88 comes into contact with the rim of the first terminal housing 5 even when the first terminal housing 5 is accidentally inserted obliquely into the second terminal housing 7 as shown in FIG. 9. Therefore, even when the first terminal housing 5 is inserted obliquely, it is possible to prevent the first terminal housing 5 from butting against and damaging the second connecting terminals 6*a* to 6*c*. Furthermore, since the second connector portion 3 is connected to an inverter in the embodiment, voltage is applied to the second connecting terminals 6*a* to 6*c* and there is a risk that a worker gets an electric shock when the first terminal housing 5 formed of aluminum comes into contact with the second connecting terminals 6*a* to 6*c*, however, such a risk of getting an electric shock can be prevented by providing the terminal protecting member 88.

The second terminal housing 7 has a hollow cylindrical body 36 having a substantially rectangular horizontal cross section. Since the first terminal housing 5 is fitted in the second terminal housing 7, an inner peripheral portion of the cylindrical body 36 on one side (on the left side in FIG. 4A) to be fitted to the first terminal housing 5 is formed in a tapered shape in light of fitting properties to the first terminal housing 5.

Figure 4A:
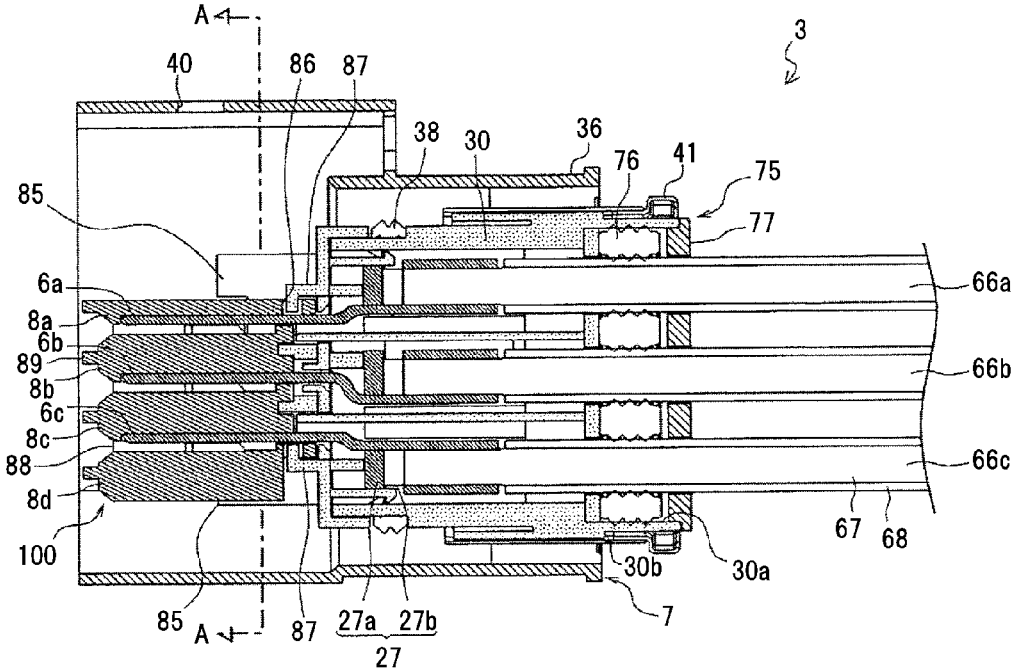
FIG. 4A is a cross sectional view showing a second connector portion of the connector in FIG. 1A.
Figure 4B:
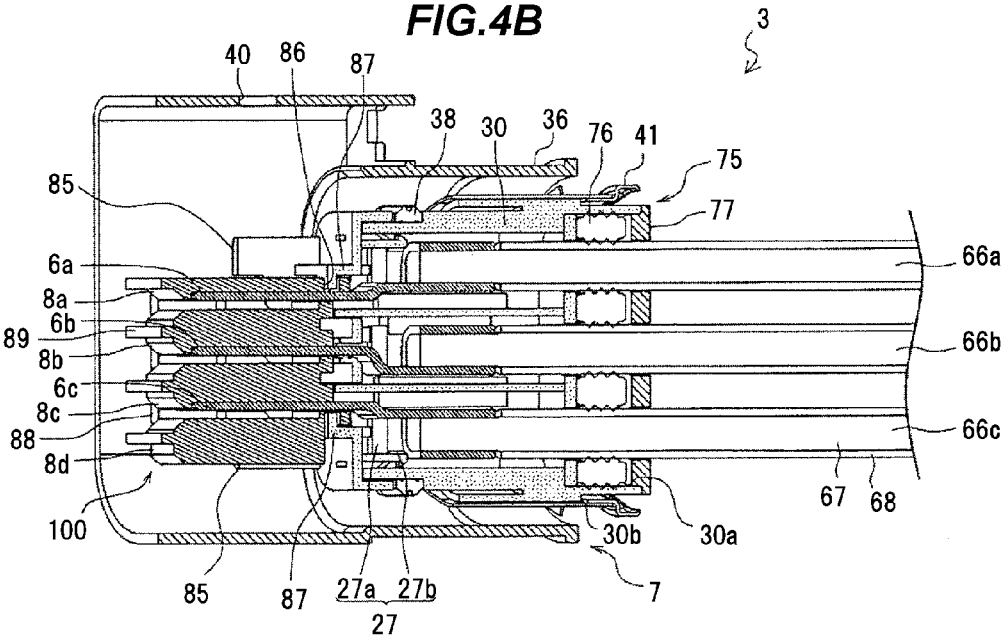
FIG. 4B is a perspective view taken obliquely viewing the cross section of FIG. 4A.
Figure 5A:
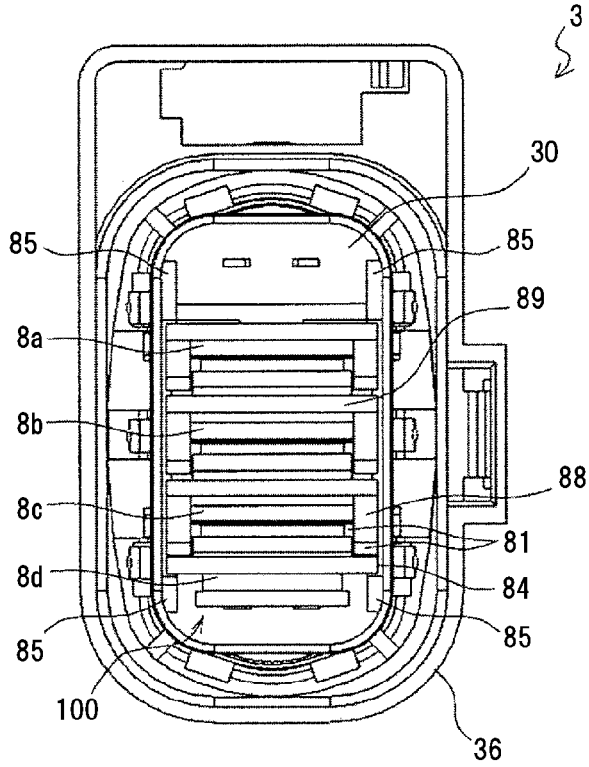
FIG. 5A is a front view showing the second connector portion in FIG. 4A.
Figure 5B:
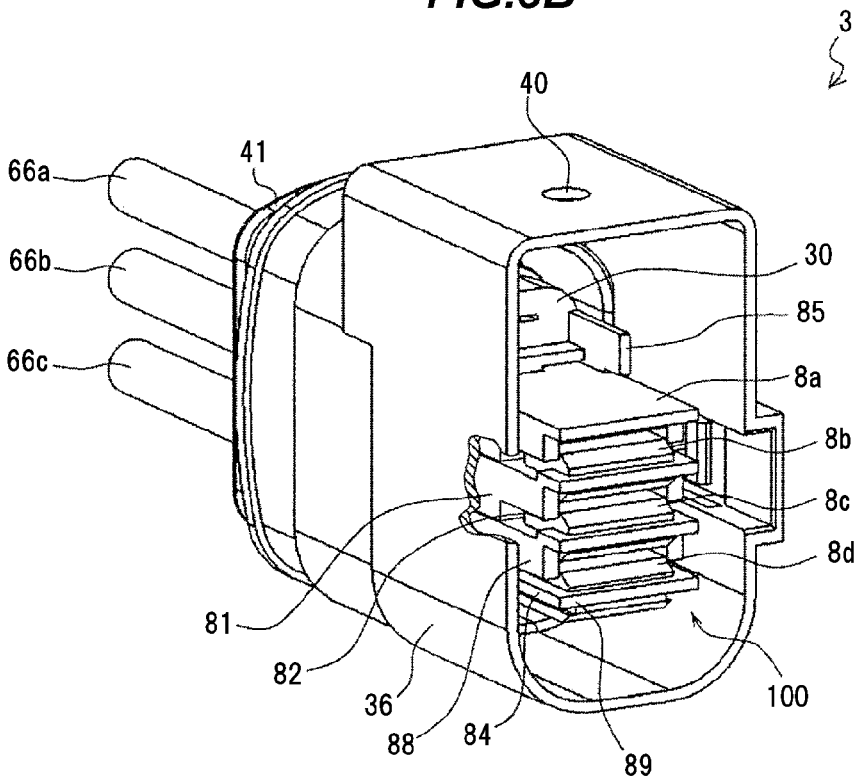
FIG. 5B is a perspective view (partially shown as a fracture cross-section) of the second connector portion in FIG. 4A.
Figure 6A:
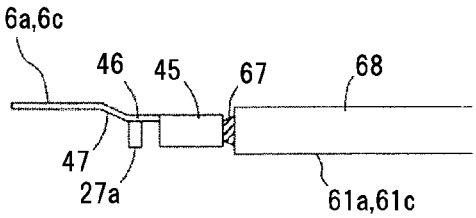
FIG. 6A is a side view showing a second connecting terminal of the connector in FIG. 1A.
Figure 6B:
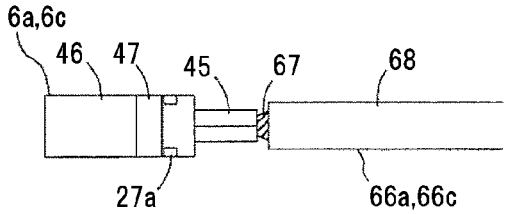
FIG. 6B is a top view showing the second connecting terminal of the connector in FIG. 6A.
Figure 7A:
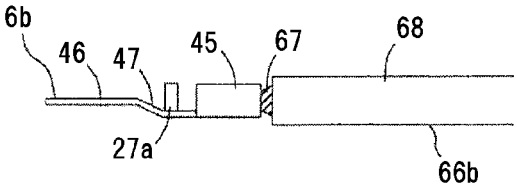
FIG. 7A is a side view showing a second connecting terminal of the connector in FIG. 1A.
Figure 7B:
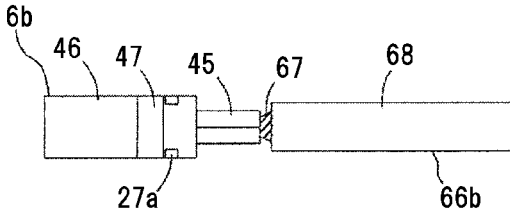
FIG. 7B is a top view showing the second connecting terminal of the connector in FIG. 7A.
Figure 8:
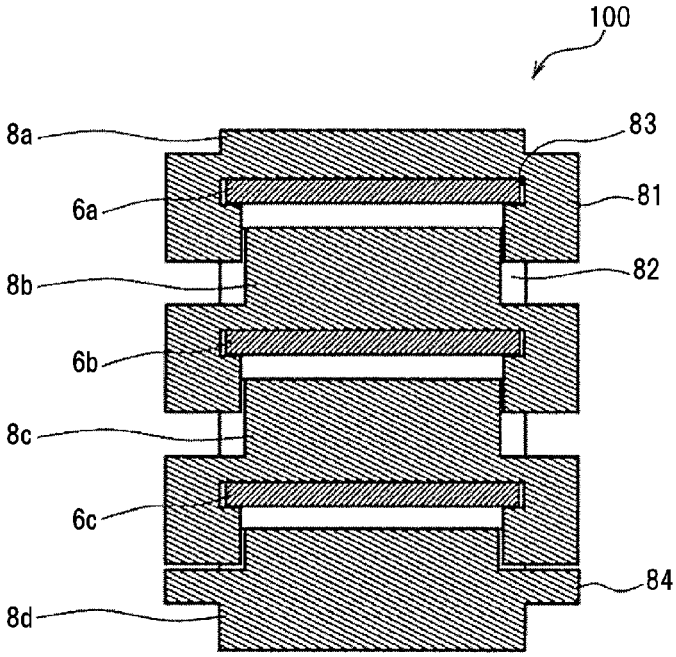
FIG. 8 is a cross sectional view cut along a line A-A in FIG. 4A.

The resin molded body 30 aligning and holding the cables 66*a* to 66*c* is housed in the cylindrical body 36 on the other end side (on the right side in FIG. 4A). Note that, the resin molded body 30 is regarded as a portion of the second terminal housing 7 in the embodiment.

A packing 38 in contact with an inner peripheral surface of the first terminal housing 5 is provided on the outer peripheral portion of the resin molded body 30 on a forward side in the fitting direction. That is, the connector 1 has a double waterproof structure composed of the packing 23 of the terminal housing waterproof structure 21 and the packing 38 provided on the outer peripheral portion of the resin molded body 30.

Furthermore, the outer periphery of the cylindrical body 36 on the other end side from where the cables 66*a* to 66*c* are led out is covered by a rubber boot for preventing water from entering into the cylindrical body 36, even though it is not illustrated.

Meanwhile, a connecting member manipulating hole 40, through which the connecting member 9 provided on the first connector portion 2 is manipulated when the second connector portion 3 is fitted to the first connector portion 2, is formed on an upper portion of the cylindrical body 36 (on the upper side in FIG. 4A). It is desirable that the connecting member manipulating hole 40 have a size not allowing a finger to get therein in order to prevent the connecting member 9 from being accidentally operated or the finger from touching the second connecting terminals 6*a* to 6*c*. In the embodiment, since the tip portions of the second connecting terminals 6*a* to 6*c* are covered by the insulating members 8*a* to 8*d*, the finger does not contact with the second connecting terminals 6*a* to 6*c*. That is, the insulating members 8*a* to 8*d* also serve as a contact preventing means which prevents a foreign object such as a finger from contacting the second connecting terminals 6*a* to 6*c*.

For shielding performance, heat dissipation and weight saving of the connector 1, the cylindrical body 36 is preferably formed of light metal having high electrical and thermal conductivity such as aluminum, but may be formed of resin, etc. Since the cylindrical body 36 is formed of an insulating resin in the embodiment, the aluminum cylindrical shield body 41 is provided on an inner peripheral surface of the cylindrical body 36 on the other end side in order to improve the shielding performance and the heat dissipation.

The cylindrical shield body 41 has a contact portion 42 which comes in contact with an outer periphery of the aluminum first terminal housing 5 when the first connector portion 2 is fitted to the second connector portion 3, and the cylindrical shield body 41 and the first terminal housing 5 are thermally and electrically connected via the contact portion 42. This improves the shielding performance and the heat dissipation. Significant improvement is expected particularly in the heat dissipation by actively releasing heat to the first terminal housing 5 which is excellent in heat dissipation.

An airtight portion 75 for ensuring air tightness between the resin molded body 30 and the cables 66*a* to 66*c* is provided on the resin molded body 30 on a cable insertion side to prevent water from trickling down through the cables 66*a* to 66*c* and entering into the second terminal housing 7. Details of the airtight portion 75 will be described later.

Connection Between First Connector Portion 2 and Second Connector Portion 3

When the two terminal housings 5 and 7 are fitted to each other, the first connecting terminals 4*a* to 4*c* are respectively inserted into gaps between the respective pairs of the second connecting terminals 6*a* to 6*c* and the insulating members 8*a* to 8*d*. The insertion provides a laminated structure in which the surfaces of the plural first connecting terminals 4*a* to 4*c* on the one side face the surfaces of the plural second connecting terminals 6*a* to 6*c* on the one side to form the respective pair, and the first connecting terminals 4*a* to 4*c*, the second connecting terminals 6*a* to 6*c* and the insulating members 8*a* to 8*d* are alternately arranged, i.e., the insulating members 8*a* to 8*d* are arranged so as to sandwich the pairs of the first connecting terminals 4*a* to 4*c* and the second connecting terminals 6*a* to 6*c*.

At this time, in the second connector portion 3, since the first insulating members 8*a* to 8*c* are respectively fixed to the tips of the second connecting terminals 6*a* to 6*c* aligned and held at predetermined intervals, each gap between the insulating members 8*a* to 8*c* can be kept without additionally providing a retaining jig for keeping gaps between the respective insulating members 8*a* to 8*c* (see Japanese patent No. 4037199). This makes easy to insert the first connecting terminals 4*a* to 4*c* into the gaps between the respective pairs of the second connecting terminals 6*a* to 6*c* and the insulating members 8*b* to 8*d*. In other words, the insertion and extraction properties of the first connecting terminals 4*a* to 4*c* are not degraded. In addition, it is very effective in that it is possible to realize further downsizing as compared to the conventional art since it is not necessary to provide a retaining jig for keeping the gaps between the insulating members 8*a* to 8*c*.

Meanwhile, a contact point between the first connecting terminal 4*a* and the second connecting terminal 6*a* is sandwiched between the first insulating member 8*a* fixed to the second connecting terminal 6*a* constituting the contact point and the first insulating member 8*b* fixed to the second connecting terminal 6*b* constituting another contact point. Meanwhile, a contact point between the first connecting terminal 4*b* and the second connecting terminal 6*b* is sandwiched between the first insulating member 8*b* fixed to the second connecting terminal 6*b* constituting the contact point and the first insulating member 8*c* fixed to the second connecting terminal 6*c* constituting another contact point. Likewise, a contact point between the first connecting terminal 4*c* and the second connecting terminal 6*c* is sandwiched between the first insulating member 8*c* fixed to the second connecting terminal 6*c* constituting the contact point and the second insulating member 8*d*.

When the rotating portion 92 of the connecting member 9 is turned by a tool such as wrench in this state and the pressing portion 93 is pressed downward, the first insulating member 8*a*, the first insulating member 8*b*, the first insulating member 8*c* and the second insulating member 8*d* are pressed in this order by the elastic member 15. Since the movement of the second insulating member 8*d* in the lamination direction is restricted by contacting with the sandwiching-holding base 43, a pressing force is imparted to each contact point by any two of the insulating members 8*a* to 8*d* sandwiching and pressing each contact point, and each contact point comes in contact in a state of being insulated from each other. At this time, the first connecting terminals 4*a* to 4*c* and the second connecting terminals 6*a* to 6*c* are bent in some degree due to pressure from the insulating members 8*a* to 8*d* and respectively make contact in a large area. This makes strong contact and fixation of each contact point even under the environment in which vibration occurs, such as in a vehicle.

In the meantime, the first connector portion 2 is provided on a motor in the embodiment. For providing the first connector portion 2 on the motor, firstly, cables (electric cables) are led out of the shield case of the motor, terminals provided at the end portions of the cables are each electrically connected to the device side connecting terminals 60*a* to 60*c* aligned and arranged on a pedestal portion 71*b* of the terminal block 71, the terminal block 71 is then fitted to the shield case of the motor, and the flange 24 is fixed to the shield case using a bolt. For electrically connecting the cable terminals of the motor to the device side connecting terminals 60*a* to 60*c*, a non-illustrated bolt is screwed into the nut 74 and contact points of the cable terminals with the device side connecting terminals 60*a* to 60*c* are each fixed between the bolt and the nut 74. The second connector portion 3 electrically connected to an inverter is fitted to the first connector portion 2 after providing the first connector portion 2 to the motor, thereby electrically connecting the motor and the inverter.

In the connector 1 of the embodiment, since the terminal block 71 is provided on the connector 1 side, it is not necessary to provide a terminal block on the motor side. Furthermore, in the connector 1, since the terminal sealing member 70 for ensuring air tightness between the terminal block 71 and the plane orienting portion 62 is provided around the plane orienting portion 62 of the bus bar terminal 65 and the packing 24*b* for ensuring air tightness between the flange 24 and the shield case is provided on the flange 24, it is not necessary to provide a sealing structure for preventing oil, etc., from leaking to, or water, etc., from entering into the motor. Therefore, the structure of the motor is simplified, which contributes to reduce weight of the entire vehicle.

Connecting Member

Next, the connecting member 9 will be described.

As shown in FIGS. 1A to 2 and 10, the connecting member 9 has a ring-shaped support 91 fixed to the first terminal housing 5, a rotating portion 92 of which upper portion is inserted into a hollow formed inside the ring-shaped support 91 so as to be pivotally supported thereby, and a pressing portion 93 vertically moving with respect to the rotating portion 92 by turning the rotating portion 92 and pressing the insulating member 8*a* adjacent thereto.

The support 91 is a ring-shaped frame fixed to the first terminal housing 5.

The rotating portion 92 has a cylindrical head portion 95 with a closed top end of which upper portion is inserted into a hollow 91*a* formed inside the ring-shaped support 91 and which is rotatably supported by the support 91, and a sliding protrusion 94 protruding downward (toward the first insulating member 8*a*) from the head portion 95. In the embodiment, two sliding protrusions 94 are formed so as to each protrude downward from opposite positions on the head portion 95. In this regard, however, the number of the sliding protrusions 94 is not limited thereto, and one or three or more sliding protrusions 94 may be formed.

The sliding protrusions 94 is formed in an arc shape in a top view so as to be along the cylindrical head portion 95. In addition, corners of the lower edge of the sliding protrusions 94 are chamfered (rounded) so as to easily slide along a stepped surface 97*a* of a below-described sliding receiving portion 97. Forming the sliding protrusions 94 in an arc shape in a top view allows strength against a vertical load to be improved as compared to the case of forming the sliding protrusions 94 into a straight shape in a top view. This results in allowing the sliding protrusions 94 to be thin, and contributes to downsize the entire connecting member 9.

The head portion 95 is formed to have a diameter slightly smaller than the inner diameter of the support 91, and is composed of a small diameter portion 95*a* inserted into the hollow 91*a* of the support 91 and a large diameter portion 95*b* integrally formed with a lower portion of the small diameter portion 95*a* and having a diameter slightly smaller than the outer diameter of the support 91. A level difference formed between the small diameter portion 95*a* and the large diameter portion 95*b* comes in contact with the lower surface of the support 91, thereby restricting upward movement of the rotating portion 92. Since a force is constantly applied upward to the head portion 95 of the rotating portion 92 by the elastic member 15 via the pressing portion 93, the vertical position of the head portion 95 of the rotating portion 92 is automatically determined when the upward movement of the head portion 95 is restricted.

Figure 10:
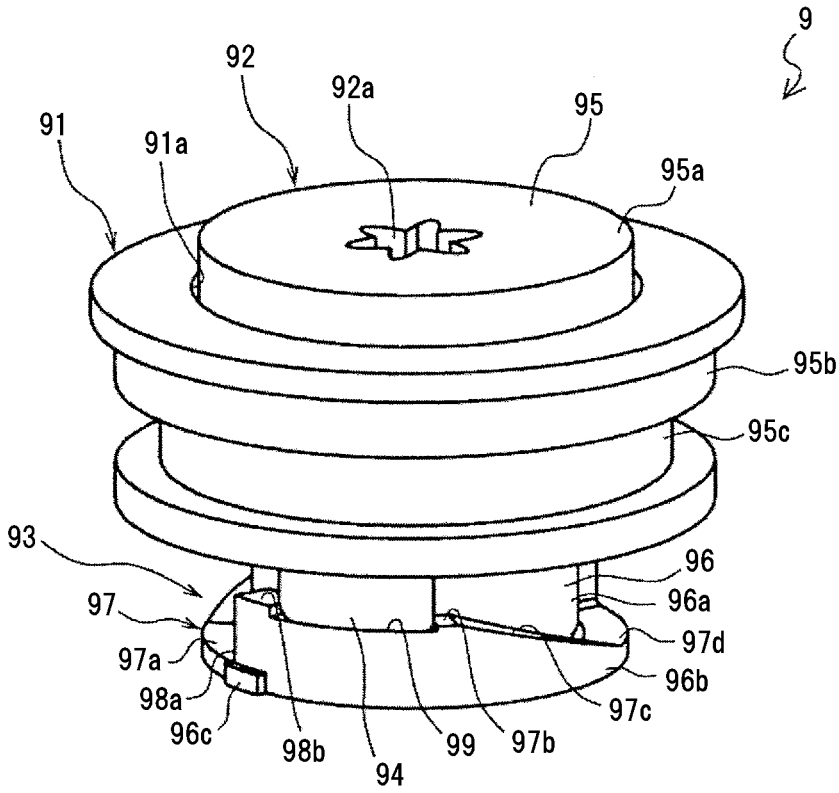
FIG. 10 is a perspective view showing a connecting member of the connector in FIG. 1A.

A groove 95*c* is formed along a circumferential direction in the middle of the large diameter portion 95*b* of the head portion 95 in the lamination direction, and a packing 14 for preventing water from entering into the first terminal housing 5 is provided in the groove 95*c* (the packing 14 is omitted in FIG. 10).

The pressing portion 93 is formed in a columnar shape, and has a main body 96 of which upper portion is inserted into a hollow of the head portion 95 of the rotating portion 92 (a hollow formed inside the cylindrical head portion 95) and of which lower portion presses the insulating member 8*a* adjacent thereto (i.e., presses toward the contact points), and a sliding receiving portion 97 as a level difference formed on the side surface of the column-shaped main body 96 along a circumferential direction so as to have a stepped surface 97*a* at the upper portion.

The main body 96 is formed to have a diameter slightly smaller than the inner diameter of the head portion 95 of the rotating portion 92, and is composed of a small diameter portion 96*a* inserted into a hollow of the head portion 95 and a large diameter portion 96*b* integrally formed with a lower portion of the small diameter portion 96*a* and having a larger diameter than the small diameter portion 96*a*. A level difference formed between the small diameter portion 96*a* and the large diameter portion 96*b* is the sliding receiving portion 97.

The sliding receiving portion 97 restricts the upward movement of the main body 96 with respect to the head portion 95 by contacting the lower edge of the sliding protrusion 94 with the stepped surface 97*a*, thereby determining a vertical position of the pressing portion 93 with respect to the rotating portion 92. Since a force is constantly applied upward to the main body 96 by the elastic member 15, the vertical position of the main body 96 is automatically determined when the upward movement of the main body 96 is restricted.

A sliding protrusion 96*c* having a rectangular shape in a front view is formed on the large diameter portion 96*b* of the main body 96 so as to protrude outward in a radial direction from the large diameter portion 96*b*. On the other hand, a vertically extending sliding groove (not shown) is formed on the first terminal housing 5 surrounding the main body 96 of the pressing portion 93, i.e., on the inner peripheral surface of the connecting member insertion hole 26. By slidably engaging the sliding protrusion 96*c* with the sliding groove, it is possible to control the main body 96 of the pressing portion 93 so as not to turn in accordance with the turning of the rotating portion 92 and to hold the pressing portion 93 so as to be slidable in a vertical direction with respect to the first terminal housing 5.

Although here is a case that the sliding protrusion 96*c* is formed on the pressing portion 93 and the sliding groove is formed on the first terminal housing 5, the positions of the protrusion and the groove may be reversed. That is, it may be configured such that a sliding protrusion is formed on the first terminal housing 5 (on the inner peripheral surface of the connecting member insertion hole 26) and a sliding groove for slidably housing the sliding protrusion is formed on the pressing portion 93.

The connector 1 in the embodiment is configured such that the pressing portion 93 moves in a vertical direction with respect to the rotating portion 92 in accordance with the turning of the rotating portion 92 by changing the vertical position of the stepped surface 97*a* of the sliding receiving portion 97 in a circumferential direction of the main body 96.

In detail, the sliding receiving portion 97 has a first horizontal portion 97*b* having the stepped surface 97*a* formed facing a direction perpendicular to the vertical direction (referred to as a horizontal direction), a slope 97*c* having the stepped surface 97*a* formed to extend diagonally downward (diagonally downward right in the drawing) along the side surface of the main body 96 from an edge of the first horizontal portion 97*b* (an edge on the right side in the drawing) and a second horizontal portion 97*d* having the stepped surface 97*a* horizontally formed from an edge of the slope 97*c* (from an edge on the right side in the drawing). That is, the sliding receiving portion 97 is configured such that the first horizontal portion 97*b* and the second horizontal portion 97*d*, which are formed at vertically different positions, are moderately connected by the slope 97*c*.

In the embodiment, since the two sliding protrusions 94 are formed at the opposite positions, the first horizontal portions 97*b*, the slopes 97*c* and the second horizontal portions 97*d* which constitute the sliding receiving portion 97 are formed, two for each, at opposite positions so as to correspond the two sliding protrusions 94. At this time, the first horizontal portion 97*b* is adjacent to the second horizontal portion 97*d*, however, since the second horizontal portion 97*d* is formed at a lower position than the first horizontal portion 97*b*, the vertical level difference 98*a* is formed therebetween. The level difference 98*a* serves to restrict the sliding protrusion 94 so as not to move (turn) to the right of the second horizontal portion 97*d*.

In addition, a protrusion 98*b* protruding upward from the stepped surface 97*a* is formed at an edge of the first horizontal portions 97*b* on the second horizontal portion 97*d* side (an edge on the left in the drawing), i.e., at the upper portion of the level difference 98*a*. The protrusion 98*b* restricts the sliding protrusion 94 so as not to move (turn) to the left of the first horizontal portion 97*b*. A vertical length from the lower edge of the level difference 98*a* to the upper edge of the protrusion 98*b* (i.e., a vertical length from the second horizontal portion 97*d* to the upper surface of the protrusion 98*b*) is substantially equal to a vertical length of the sliding protrusion 94 (i.e., a vertical length from the lower edge of the sliding protrusion 94 to the lower surface of the head portion 95).

A protrusion supporting portion 99 in a recessed shape for housing the lower edge of the sliding protrusion 94 is formed on the stepped surface 97*a* of the first horizontal portion 97*b* (on the stepped surface 97*a* on the left of the protrusion 98*b*). The protrusion supporting portion 99 prevents application of the pressing force to each contact point from being released due to unintentional turning of the head portion 95 of the rotating portion 92 caused by vibration, etc. The protrusion 98*b* is configured to come into contact with a left edge of the sliding protrusion 94 when the lower edge of the sliding protrusion 94 is housed in the protrusion supporting portion 99.

In addition, by forming the protrusion supporting portion 99, vibration (or change in an operational feeling) at the time of fitting the sliding protrusion 94 to the protrusion supporting portion 99 is transmitted to a hand of a worker who is operating a tool such as a wrench, which makes the worker feel that the sliding protrusion 94 is fitted to the protrusion supporting portion 99, i.e., the rotating portion 92 is turned to a position not allowing further turning. That is, the protrusion supporting portion 99 serves to inform the worker that the rotating portion 92 is sufficiently turned and to prevent the worker from excessively turning the rotating portion 92.

It is desirable that the support 91, the rotating portion 92 and the pressing portion 93 of the connecting member 9 be formed of an iron-based material such as SUS from the viewpoint of durability and mechanical strength.

Next, the specific turning movement of the connecting member 9 will be described in reference to FIGS. 11A to 11D.

Figure 11A:
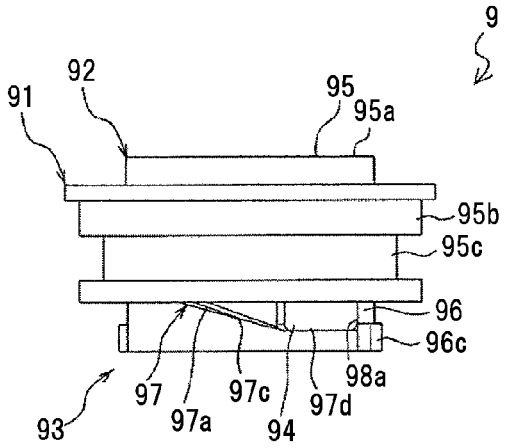
FIGS. 11A to 11D illustrate the turn operation of the connecting member in FIG. 10.

As shown in FIG. 11A, the rotating portion 92 is initially turned to the left in a top view (counterclockwise) with respect to the support 91 to position the sliding protrusion 94 on the second horizontal portion 97*d*. At this time, the level difference 98*a* restricts the movement (turning) of the sliding protrusion 94, thereby preventing the rotating portion 92 from being excessively turned.

In the state that the sliding protrusion 94 is positioned on the second horizontal portion 97*d*, the main body 96 of the pressing portion 93 is moved to the uppermost position (the opposite side to the first insulating member 8*a*). The first terminal housing 5 is fitted to the second terminal housing 7 in this state and the first connecting terminals 4*a* to 4*c* are inserted into gaps between the second connecting terminals 6*a* to 6*c* and the insulating members 8*b* to 8*d* facing thereto.

Figure 11B:
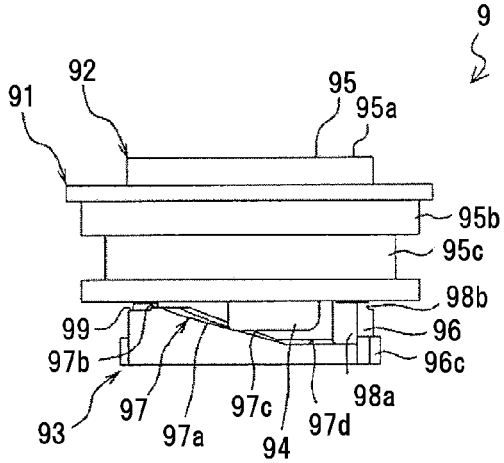

After that, the rotating portion 92 is turned to the right in a top view (clockwise) with respect to the support 91 as shown in FIG. 11B. Accordingly, the sliding protrusion 94 slides along the stepped surface 97*a* of the sliding receiving portion 97 and climbs up the slope 97*c*, the main body 96 of the pressing portion 93 which is gradually pressed down against a spring force of the elastic member 15 presses the adjacent first insulating member 8*a* via the elastic member 15, and the pressing force is thereby gradually applied to each contact point.

Figure 11C:
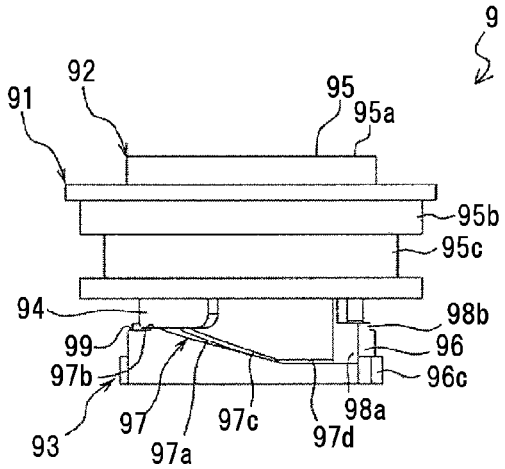

When the rotating portion 92 is further turned, the sliding protrusion 94 climbs over the first horizontal portion 97*b*, as shown in FIG. 11C. The main body 96 of the pressing portion 93 is moved to the lowermost position (on the first insulating member 8*a* side) at this stage, thereby becoming a state in which a sufficient pressing force is applied to each contact point.

Figure 11D:
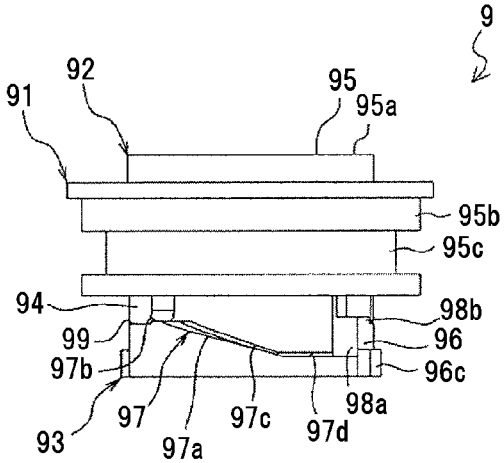

When the rotating portion 92 is still further turned, the sliding protrusion 94 is housed in the protrusion supporting portion 99 as shown in FIG. 11D. Since vibration (or change in an operational feeling) is transmitted to a hand of a worker who is operating a tool such as a wrench when the sliding protrusion 94 is fitted to the protrusion supporting portion 99, the worker finishes turning the rotating portion 92 at the point that he (she) feels the vibration (or the change in an operational feeling). Meanwhile, when the sliding protrusion 94 is housed in the protrusion supporting portion 99, the movement (turning) of the sliding protrusion 94 is restricted by the protrusion 98*b* and the rotating portion 92 is prevented from excessively turning.

A comparison between the state before turning the rotating portion 92 (the state shown in FIG. 11A) and the state after turning the rotating portion 92 (the state shown in FIG. 11D) shows that, in the connector 1 of the embodiment, a vertical position of the upper surface of the connecting member 9 (i.e., the upper surface of the head portion 95 of the rotating portion 92) does not change before and after turning the rotating portion 92. Therefore, in the connector 1, a contact of a tool such as a wrench with other members due to the vertical movement of the connecting member 9 does not occur during the operation of the tool and it is easy to turn the tool. In addition, since the connecting member 9 does not plunge into the first terminal housing, it is easy to see the irregular-shaped hole 92*a* for fitting the tool, which contributes to improve workability.

Airtight Portion

The airtight portion 75 will be described below.

As shown in FIGS. 4A, 4B and 12A to 12C, the airtight portion 75 has a packing 76 as a sealing member which is housed in a housing portion 30*a* formed on the resin molded body 30 at the edge on the cable insertion side and is airtightly in contact with both the resin molded body 30 and the cables 66*a* to 66*c*, and a tail plate 77 for preventing the packing 76 from dropping off from the housing portion 30*a* by engaging with the resin molded body 30 and blocking an opening of the housing portion 30*a*.

Figure 12A:
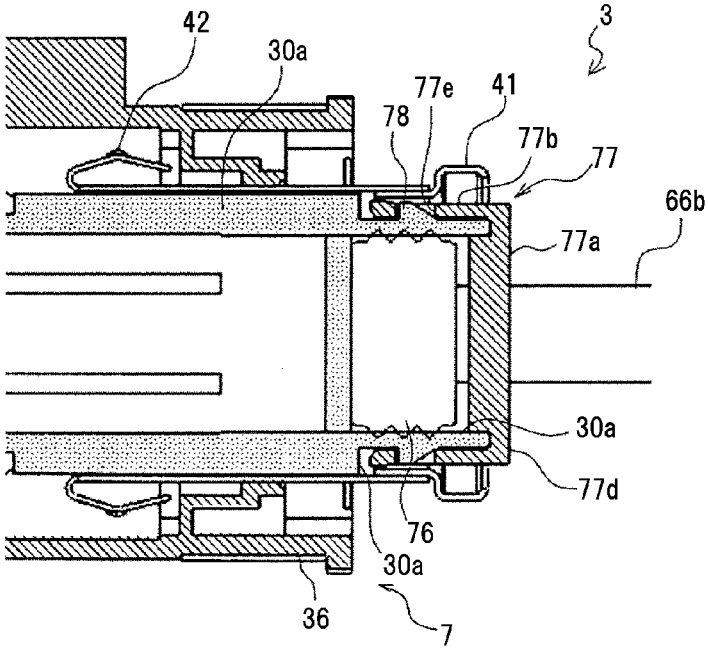
FIG. 12A is an enlarged cross sectional view showing the vicinity of an airtight portion of the second connector portion in FIG. 4A.
Figure 12B:
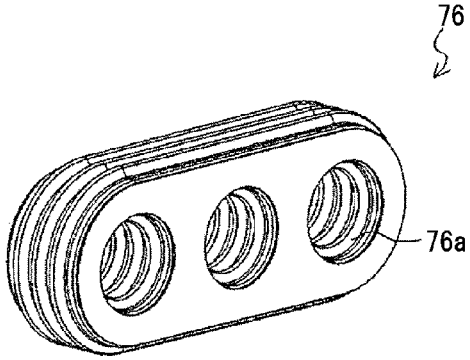
FIG. 12B is a perspective view showing a packing of the airtight portion.

As shown in FIG. 12B, three insertion holes 76*a* for inserting three cables 66*a* to 66*c* therethrough are formed on the packing 76 which is mutually used for the three cables 66*a* to 66*c*. Alternatively, a packing may be individually provided for each of the cables 66*a* to 66*c*, however, it is not preferable since it is necessary to provide a dividing wall between adjacent housing portions in this case, leading to an increase in the size of the entire connector 1.

Figure 12C:
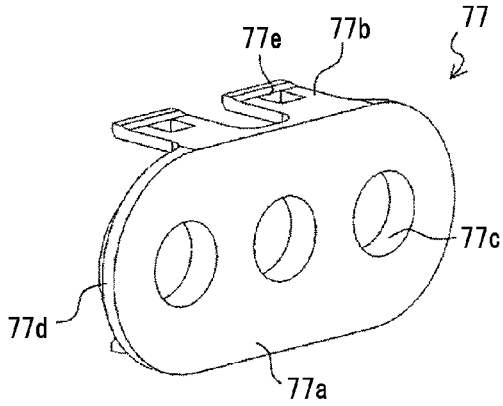
FIG. 12C is a perspective view showing a tail plate of the airtight portion.

As shown in FIGS. 12A and 12C, the tail plate 77 has a plate portion 77*a* for blocking the opening of the housing portion 30*a* and tongue-shaped engaging pieces 77*b* protruding forward in the fitting direction (toward the resin molded body 30) from both widthwise sides of the plate portion 77*a* to engage the resin molded body 30.

Three insertion holes 77*c* for inserting the three cables 66*a* to 66*c* therethrough are formed on the plate portion 77*a*. In addition, a flange 77*d* in contact with the rim around the opening of the housing portion 30*a* is formed at a rear end portion of the plate portion 77*a*, and a portion of the plate portion 77*a* anterior to the flange 77*d* in the fitting direction is housed in the housing portion 30*a*.

The engaging pieces 77*b* are provided on the plate portion 77*a* at upper and lower portions in FIG. 12C so as to face each other. In the embodiment, four engaging pieces 77*b* are formed in total, two each on upper and lower portions of the plate portion 77*a*. An engaging hole 77*e* is each formed at an end portion of each engaging piece 77*b*, and the tail plate 77 is fixed to the resin molded body 30 by engaging a locking projection 78 formed on the outer wall of the resin molded body 30 with the engaging hole 77*e*.

The connector 1 in the embodiment is further provided with a hold-down member which prevents the engaging piece 77*b* from being disengaged from the locking projection 78 by sandwiching the end portion of the engaging piece 77*b* of the tail plate 77 between the outer wall of the resin molded body 30 and the hold-down member and restricting movement of the engaging piece 77*b* in a direction to separate from the resin molded body 30. In the embodiment, the cylindrical shield body 41 which is a metal shield plate having a shielding function is used as the hold-down member.

In the embodiment, a level difference 30*b* is formed on the outer wall of the resin molded body 30 at the end portion on the cable insertion side so that the portion on the cable insertion side is lower, and the locking projection 78 is formed on the outer wall lowered by the level difference 30*b* such that the height of the locking projection 78 and the thickness of the engaging piece 77*b* are smaller than the height (depth) of the level difference 30*b*. Such a configuration allows the cylindrical shield body 41 as a hold-down member to be flat and further to be reinforced at the portion for sandwiching the end portion of the engaging piece 77*b* by partially thickening. The connector 1 is configured that the portion of the cylindrical shield body 41 for sandwiching the end portion of the engaging piece 77*b* is thickened by overlapping and welding two metal shield plates for reinforcement. Note that, in the connector 1, the diameter of the rear end portion of the cylindrical shield body 41 (the end portion on the right side in FIG. 12A) is enlarged so as to have a flange shape, which serves as a band slip-off stopper when a non-illustrated braided shield is fixed to the cylindrical shield body 41 by a band.

In addition, although the embodiment is configured such that the cylindrical shield body 41 as a hold-down member comes into contact with and presses the end portion of the engaging piece 77*b*, the cylindrical shield body 41 may not come into contact with the end portion of the engaging piece 77*b*. In this case, dimension of each member should be adjusted so that the thickness of the engaging piece 77*b* is not smaller than the gap between the cylindrical shield body 41 and the locking projection 78.

Figure 13A:
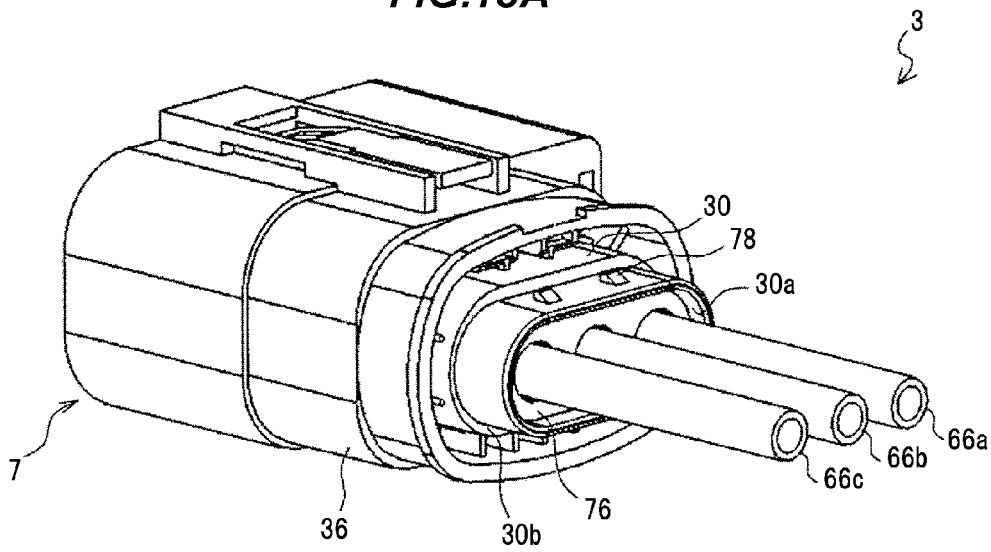
Figure 13B:
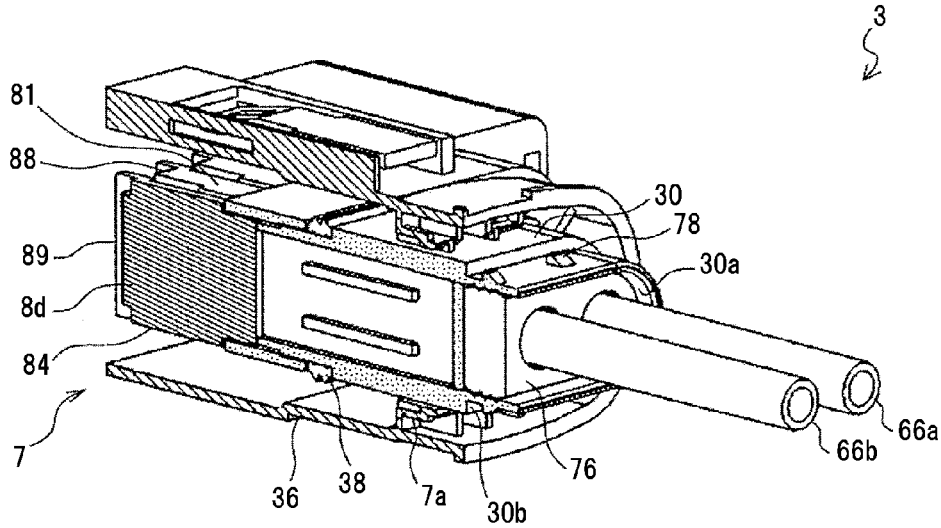

For assembling the second connector portion 3, firstly, the resin molded body 30 assembled with the second connecting terminals 6*a* to 6*c*, the cables 66*a* to 66*c* and the insulating member assembly 100 is inserted into and fixed to the second terminal housing 7, and the packing 76 is then housed in the housing portion 30*a* of the resin molded body 30 as shown in FIGS. 13A and 13B. Plural engaging claws 7*a* are formed on the inner wall of the second terminal housing 7, and the resin molded body 30 is fixed to the second terminal housing 7 by engaging the engaging claws 7*a* with the resin molded body 30.

Figure 14:
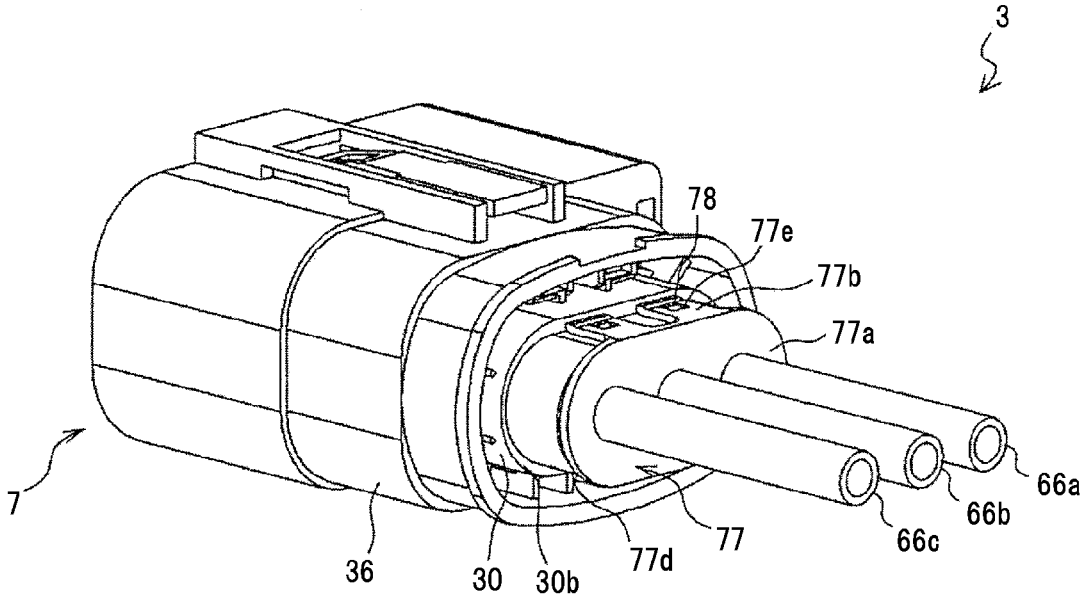
FIG. 14 illustrates the assembly procedure of the second connector portion in FIG. 4A, and is a perspective view showing a state in which the tail plate is attached to the resin molded body.

After that, the engaging hole 77*e* of the engaging piece 77*b* is engaged with the locking projection 78 as shown in FIG. 14, thereby engaging the tail plate 77 with the resin molded body 30.

Figure 15A:
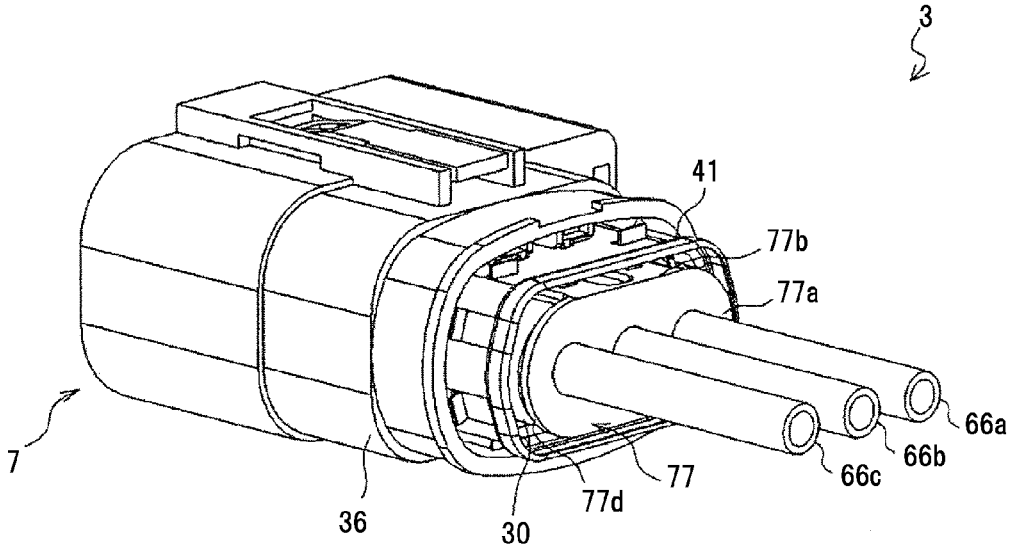
Figure 15B:
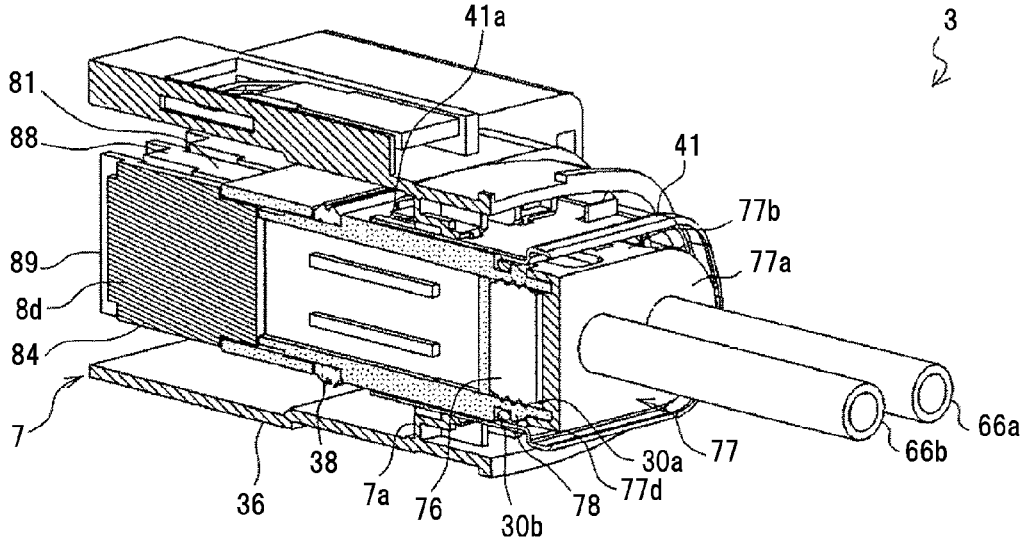

After engaging the tail plate 77 with the resin molded body 30, the cylindrical shield body 41 is inserted, from the cable insertion side, into a gap between the second terminal housing 7 and the resin molded body 30 as shown in FIGS. 15A and 15B. A notch 41*a* for letting through the engaging claw 7*a* is formed on the cylindrical shield body 41. In addition, a stopper (a folded back portion formed by outwardly bending a portion of the cylindrical shield body 41) is formed on the cylindrical shield body 41 even though it is not illustrated, and the cylindrical shield body 41 is fixed to the second terminal housing 7 by engaging the stopper with a protrusion (not shown) formed on the inner wall of the second terminal housing 7.

Effects of the Embodiment

The effects of the embodiment will be described below.

In the connector 1 of the embodiment, the plural insulating members 8*a* to 8*d* are housed in the second terminal housing 7 of the second connector portion 3 as a female connector, the insulating member assembly 100 is formed by connecting the plural insulating members 8*a* to 8*d* to each other so as to restrict the movement of the insulating members 8*a* to 8*d* in the fitting direction and in the width direction, and the restricting protrusion 85 is provided on the resin molded body 30 so as to sandwich the insulating member assembly 100 in the lamination direction in order to restrict expanding movement of the insulating member assembly 100 in the lamination direction when inserting the first connecting terminals 4*a* to 4*c* into between the second connecting terminals 6*a* to 6*c* and the insulating members 8*a* to 8*d*.

By thus forming the insulating member assembly 100, it is possible to prevent the relative misalignment of the insulating members 8*a* to 8*d* even when a force (e.g., a force to pull the cables 66*a* to 66*c* or a force to push the cables 66*a* to 66*c* into the second connector portion 3) is applied to the cables 66*a* to 66*c*.

In addition, providing the restricting protrusion 85 suppresses excess expansion of the insulating member assembly 100 in the lamination direction when the two connector portions 2 and 3 are fitted to each other, and the position of the insulating member assembly 100 in the lamination direction with respect to the resin molded body 30 is restricted within a range sandwiched by the restricting protrusion 85. The resin molded body 30 is fixed to the second terminal housing 7, and as a result, the position of the insulating member assembly 100 in the lamination direction with respect to the resin molded body 30 is determined and the misalignment of the insulating members 8*a* to 8*d* with respect to the second terminal housing 7 is prevented.

As described above, in the connector 1, it is possible to prevent both of the relative misalignment between the insulating members 8*a* to 8*d* and the misalignment thereof with respect to the second terminal housing 7 even in the case of providing the insulating members 8*a* to 8*d* in the second connector portion 3 as a female connector. As a result, it is possible to prevent the first connecting terminals 4*a* to 4*c* from butting against the insulating members 8*a* to 8*d* when connecting the two connector portions 2 and 3 and to smoothly carry out a fitting operation. In addition, the connector 1 is small since a retaining jig is not used unlike the conventional connector.

Furthermore, in the connector 1, the terminal protecting member 88 which comes into contact with a rim of the first terminal housing 5 to prevent the first terminal housing 5 from being inserted into the gaps for inserting the first connecting terminals 4*a* to 4*c* is provided on the insulating member assembly 100.

Accordingly, the first terminal housing 5 does not butt against and damage the second connecting terminals 6*a* to 6*c*, and it is possible to prevent the second connecting terminals 6*a* to 6*c* from being damaged even if the first terminal housing 5 is inserted obliquely in the case where, e.g., the fitting work of the connector 1 is carried out in a narrow space. In the connector 1, the both sides of the second connecting terminals 6*a* to 6*c* in the lamination direction are covered by the insulating members 8*a* and 8*d*, which can prevent the first terminal housing 5 from butting against the second connecting terminals 6*a* to 6*c* from the both sides in the lamination direction.

Meanwhile, it may be considered that, for example, the first terminal housing 5 is formed to have a rim thicker than the gaps for inserting the first connecting terminals 4*a* to 4*c* in order to prevent the first terminal housing 5 being inserted into the gaps for inserting the first connecting terminals 4*a* to 4*c*. However, it is not preferable for the connector 1 since the insulating members 8*a* to 8*d* constituting the insulating member assembly 100 are movable in the lamination direction within the range sandwiched by the restricting protrusion 85 and the first terminal housing 5 thus needs to be formed to have a very thick rim, which leads to an increase in the size of the entire connector 1. In addition, in a case of thickening only the rim of the first terminal housing 5, a sealing structure between the two terminal housings 5 and 7 becomes complicated. According to the invention, it is possible to suppress an increase in the size of the connector 1 and to prevent the second connecting terminals 6*a* to 6*c* from being damaged while the sealing structure is the same as the conventional art.

In addition, in the connector 1, the terminal protecting member 88 provided on both sides of the gaps for inserting the first connecting terminal 4*a* to 4*c* in a protruding manner can prevent insertion of the first terminal housing 5 into such gaps and damage to the second connecting terminals 6*a* to 6*c*.

It should be noted that the invention is not intended to be limited to the embodiment, and the various changes can be made without departing from the gist of the invention.

For example, the embodiment assumes the use of a three-phase AC power line, however, according to the technical idea of the invention, it may be, e.g., a connector for a vehicle which is configured to collectively connect lines used for different purposes such as a three-phase AC power line between a motor and an inverter and a two-phase DC power line for air conditioner. Since the configuration described above allows one connector to collectively connect power lines used for different purposes, it is not necessary to prepare different connectors for each intended purpose and it is thus possible to contribute to space saving and cost reduction.

Alternatively, surfaces of the first connecting terminals 4*a* to 4*c* and of the second connecting terminals 6*a* to 6*c* may be each roughened by a knurling process to increase frictional force so as to make the terminals difficult to move, thereby strengthening the fixation at each contact point.

In addition, although the case where the first insulating members 8*a* to 8*c* are provided to the second connecting terminals 6*a* to 6*c* by fitting the second connecting terminals 6*a* to 6*c* to the fitting grooves 83 has been described in the embodiment, the first insulating members 8*a* to 8*c* may be provided on the second connecting terminals 6*a* to 6*c* by insert molding or by press-fitting the second connecting terminals 6*a* to 6*c* into the first insulating members 8*a* to 8*c*.

In addition, although a cable excellent in flexibility is used as the cables 66*a* to 66*c* in the embodiment, a rigid cable may be used.

In addition, in the embodiment, a direction of the connecting member 9 may be either substantially horizontal or substantially vertical when the connector is in use. In other words, a direction in a usage state is not a requirement in the use conditions of the connector of the embodiment.

In addition, although the main body 96 of the pressing portion 93 presses the first insulating member 8*a* adjacent thereto via the elastic member 15 which is a portion of the connecting member 9 in the embodiment, the adjacent first insulating member 8*a* may be pressed directly by the main body 96, not via the elastic member 15.

In addition, although the case of providing the connecting member 9 on only one side of the first terminal housing 5 has been described in the embodiment, the connecting member 9 may be provided on both sides of the first terminal housing 5 so that a pressing force is imparted to each contact point by the two connecting members 9 provided on the both sides.

In addition, although the main body 96 of the pressing portion 93 is formed in a substantially columnar shape in the embodiment, a shaft penetrating through each contact point may be integrally formed with the main body 96 so as to be a through type.

What is claimed is:

1. A connector, comprising:

a first terminal housing for housing a plurality of first connecting terminals aligned;

a second terminal housing for housing a plurality of second connecting terminals aligned;

a plurality of insulating members aligned and housed in the second terminal housing;

a laminated structure that a front end portion of the first terminal housing is housed in the second terminal housing, and one surface of the plurality of first connecting terminals faces one surface of the plurality of second connecting terminals to form pairs and to form a plurality of contact points sandwiched between the plurality of insulating members when the first terminal housing is fitted to the second terminal housing;

a connecting member for collectively fixing and electrically connecting the plurality of first connecting terminals and the plurality of second connecting terminals at each contact point by pressing the plurality of first connecting terminals and the plurality of second connecting terminals;

a resin molded body provided in the second terminal housing behind the plurality of insulating members in a fitting direction to hold the plurality of second connecting terminals; and an insulating member assembly formed by assembling the plurality of insulating members so as to restrict movement of each of the insulating members in the fitting direction and in a width direction perpendicular to a lamination direction of the laminated structure and to the fitting direction, wherein the resin molded body comprises at least one pair of restricting protrusions to sandwich the insulating member assembly in the lamination direction in order to restrict expanding movement of the insulating member assembly in the lamination direction when inserting the first connecting terminals into a gap between the second connecting terminals and the insulating members, and wherein the insulating member assembly comprises a terminal protecting member to interfere with a rim of the first terminal housing to prevent the first terminal housing from being erroneously inserted into the gap for receiving the first connecting terminals.

2. The connector according to claim 1, wherein the terminal protecting member is formed protruding from the insulating member assembly in the insertion direction of the first connecting terminals at both sides of the gap in the width direction for receiving the first connecting terminals.

3. The connector according to claim 1, wherein the insulating members comprise a plurality of first insulating members each provided on another surface of the plurality of second connecting terminals, and a second insulating member arranged to face another surface of the first connecting terminal that is located outermost when the plurality of first connecting members are alternately stacked on the plurality of second connecting terminals, wherein the first insulating members each comprise a connecting piece that extends from both ends of the first insulating members in a width direction thereof toward adjacent one of first and second insulating members, wherein the first insulating members or the second insulating member comprise a connecting groove receiving the connecting piece to be slidable in the lamination direction, formed on both side surfaces thereof, and wherein the terminal protecting member protrudes forward in the fitting direction from the connecting piece.

* * * * *